US007455287B2

(12) United States Patent
Shiohara et al.

(10) Patent No.: US 7,455,287 B2
(45) Date of Patent: Nov. 25, 2008

(54) RECORDING MEDIUM FEEDER WITH MULTIPLE FRICTIONAL SURFACES AND IMAGE RECORDING DEVICE

(75) Inventors: Yukio Shiohara, Nagoya (JP); Tetsuo Asada, Kuwana (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 279 days.

(21) Appl. No.: 11/115,379

(22) Filed: Apr. 27, 2005

(65) Prior Publication Data

US 2005/0242485 A1 Nov. 3, 2005

(30) Foreign Application Priority Data

Apr. 28, 2004 (JP) ..... 2004-134487

(51) Int. Cl.
*B65H 3/52* (2006.01)

(52) U.S. Cl. ..... 271/121; 271/117; 271/167

(58) Field of Classification Search ..... 271/109, 271/117, 121, 122, 167
See application file for complete search history.

(56) References Cited

U.S. PATENT DOCUMENTS

| | | | | |
|---|---|---|---|---|
| 5,052,677 | A * | 10/1991 | Shibata | 271/164 |
| 5,183,248 | A | 2/1993 | Okada et al. | |
| 5,528,352 | A * | 6/1996 | Ichinokawa et al. | 399/365 |
| 5,570,876 | A * | 11/1996 | Samii | 271/119 |
| 5,584,475 | A * | 12/1996 | Asada et al. | 271/121 |
| 5,934,664 | A * | 8/1999 | Murayama et al. | 271/118 |
| 6,170,701 | B1 | 1/2001 | Youn | |
| 6,227,535 | B1 | 5/2001 | Bae | |
| 6,371,477 | B1 * | 4/2002 | Lin | 271/121 |
| 2002/0003332 | A1 * | 1/2002 | Hiratani | 271/121 |
| 2004/0012140 | A1 | 1/2004 | Asada et al. | |
| 2004/0065992 | A1 * | 4/2004 | Youn | 271/121 |

(Continued)

FOREIGN PATENT DOCUMENTS

JP 60178136 A * 9/1985

(Continued)

OTHER PUBLICATIONS

European Search Report for Application No. 05252626.6; dated Aug. 9, 2005.

(Continued)

*Primary Examiner*—Patrick Mackey
*Assistant Examiner*—Gerald W McClain
(74) *Attorney, Agent, or Firm*—Banner & Witcoff, Ltd

(57) ABSTRACT

A recording medium feeder includes: a tray on which a plurality of recording medium are to be stacked; a feed roller that feeds the recording medium stacked on the tray; a first friction member provided on the tray and having high friction coefficient; and a second friction member provided on the tray at a position opposing the feed roller and having low friction coefficient that is lower than the friction coefficient of the first friction member, wherein the first friction member is configurable to be in one of positions of a protruded position in which a surface of the first friction member is protruded from a surface of the second friction member towards the feed roller and a retracted position in which the surface of the first friction member is arranged to be not higher than the surface of the second friction member.

23 Claims, 22 Drawing Sheets

U.S. PATENT DOCUMENTS

2005/0275156 A1* 12/2005 Flynn et al. ..... 271/167

FOREIGN PATENT DOCUMENTS

| | | | |
|---|---|---|---|
| JP | 1-104537 | | 4/1989 |
| JP | 01104537 | * | 4/1989 |
| JP | 1-127532 | | 5/1989 |
| JP | 03-067825 | | 3/1991 |
| JP | 03067825 A | * | 3/1991 |
| JP | 2000-159368 | | 6/2000 |
| JP | 2000159368 A | * | 6/2000 |
| JP | 2002-249248 | | 9/2002 |
| JP | 2002249248 | | 9/2002 |
| JP | 2003118861 A | * | 4/2003 |
| JP | 2004-051302 | | 2/2004 |
| JP | 2004051302 | | 2/2004 |

OTHER PUBLICATIONS

Japanese Office Action dated Mar. 26, 2008, in corresponding Japanese application No. 2004-134487, with English translation.

* cited by examiner

RECORDING MEDIUM FEEDER WITH MULTIPLE FRICTIONAL SURFACES AND IMAGE RECORDING DEVICE

BACKGROUND OF THE INVENTION

1. Field of the Invention

The present invention relates to the configuration of a recording medium feeder for separating accumulated cut sheets (recording medium) one by one, thereby feeding the sheet to a recording section, or the like; and to the configuration of an image recording device of an inkjet type, or the like, including the recording medium feeder.

2. Description of the Related Art

An image recording device of related art, such as any of a variety of printers or facsimile machines, includes a paper feeder for feeding a plurality of sheets of paper (cut sheets, recording mediums) stacked (accumulated) on a hopper section by means of rotation of a paper feed roller (a rotary feeding member). As the paper feeder, that adopting a horizontal-stacking method in which a plurality of sheets are stacked horizontally, and that adopting an inclined-stacking method in which the same are stacked in a vertically inclined state, have been put into practice.

For instance, in a paper feeder of the inclined-stacking method disclosed in JP-A-2004-051302, a frictional pad made of cork, which is high in friction coefficient, or the like, is disposed in the vicinity of a lower end (at a position facing a paper feed roller) of an inclined wall. The inclined wall supports the back (the side opposite the paper feed roller) of paper stacked in an inclined manner. Since a lower face of a lowermost sheet of paper is brought into contact with the frictional pad, paper slides less easily. In addition, occurrence of multi-feed including the lowermost sheet at a time of paper feeding can be prevented even when the remaining number of accumulated sheets becomes small (See FIGS. 2, 5, and 11 of JP-A-2004-051302).

In addition, JP-A-2002-249248 discloses a paper feeder configured as follows. A paper feed roller is disposed on an upper face side of a paper feed cassette on which a plurality of sheets are stacked horizontally. The paper, which is fed by means of the paper feed roller, is transported to a lower face of a recording head by way of an upward, U-turn transport path including a reverse roller. After recording, the paper is discharged to a front face side of a housing of the image recording device (See FIG. 1 of JP-A-2002-249248).

SUMMARY OF THE INVENTION

Meanwhile, in a paper feeder of a type, as disclosed in JP-A-2004-051302, which causes paper to make a U-turn, thereby transporting (feeding) the paper to the recording section, the paper is stacked with a face to be recorded facing downward.

In this case, when the member of high friction coefficient of JP-A-2004-051302 is fixed to a bottom face of a paper feed cassette, the following problem arises. That is, on paper which has been subjected to special processing for forming an ink-absorbing layer or a cast-coated (gloss-imparting) for the purpose of imparting glossiness, a silica (silicon dioxide: $SiO_2$) layer is formed on the surface of the paper, as in the case of an inkjet-dedicated paper or glossy paper. Accordingly, when the paper is stacked with the processed face (recording face) facing downward, the processed face of a lowermost sheet of paper encounters difficulty in sliding in relation to the member of high friction coefficient. Consequently, even with a driving force of the paper feed roller, the lowermost sheet of paper cannot be separated from the member of high friction coefficient, and feeding of the last sheet is disabled.

In addition, the following problem is also entailed. That is, in a case where a drive motor of the paper feed roller is a stepping motor, when a driving force of the motor exceeds an upper limit of a predetermined value (drive torque), the stepping motor is pulled out of synchronization, and further load is not applied on a drive system. However, when a DC (direct current) motor is employed for cost saving, a control system feeds an excessive current in an attempt to forcibly rotate the paper feed roller, whereby the motor may be burned out or a drive transmission system may be broken.

The present invention has been conceived to solve the problems, and one of objects thereof is to provide a recording medium feeder that feeds a last sheet of paper without fail even when the sheet (recording medium) is subjected to special surface processing, by employment of a comparatively simple configuration, and to provide an image recording device including the same.

According to a first aspect of the invention, there is provided a recording medium feeder including: a tray on which a plurality of recording medium are to be stacked; a feed roller that feeds the recording medium stacked on the tray; a first friction member provided on the tray and having high friction coefficient; and a second friction member provided on the tray at a position opposing the feed roller and having low friction coefficient that is lower than the friction coefficient of the first friction member, wherein the first friction member is configurable to be in one of positions of a protruded position in which a surface of the first friction member is protruded from a surface of the second friction member towards the feed roller and a retracted position in which the surface of the first friction member is arranged to be not higher than the surface of the second friction member.

According to a second aspect of the invention, there is provided an image recording device including: a main body case; a tray on which a plurality of recording medium are to be stacked horizontally, the tray being allowed to insert and withdraw in and from the main body case; a feed roller that feeds the recording medium stacked on the tray; a first friction member provided on the tray and having high friction coefficient; a second friction member provided on the tray at a position opposing the feed roller and having low friction coefficient that is lower than the friction coefficient of the first friction member; and an image forming section that forms image on the recording medium fed by the feed roller, wherein the first friction member is configurable to be in one of positions of a protruded position in which a surface of the first friction member is protruded from a surface of the second friction member towards the feed roller and a retracted position in which the surface of the first friction member is arranged to be not higher than the surface of the second friction member.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

An embodiment of the invention will be described in detail herein below.

Figure 1:
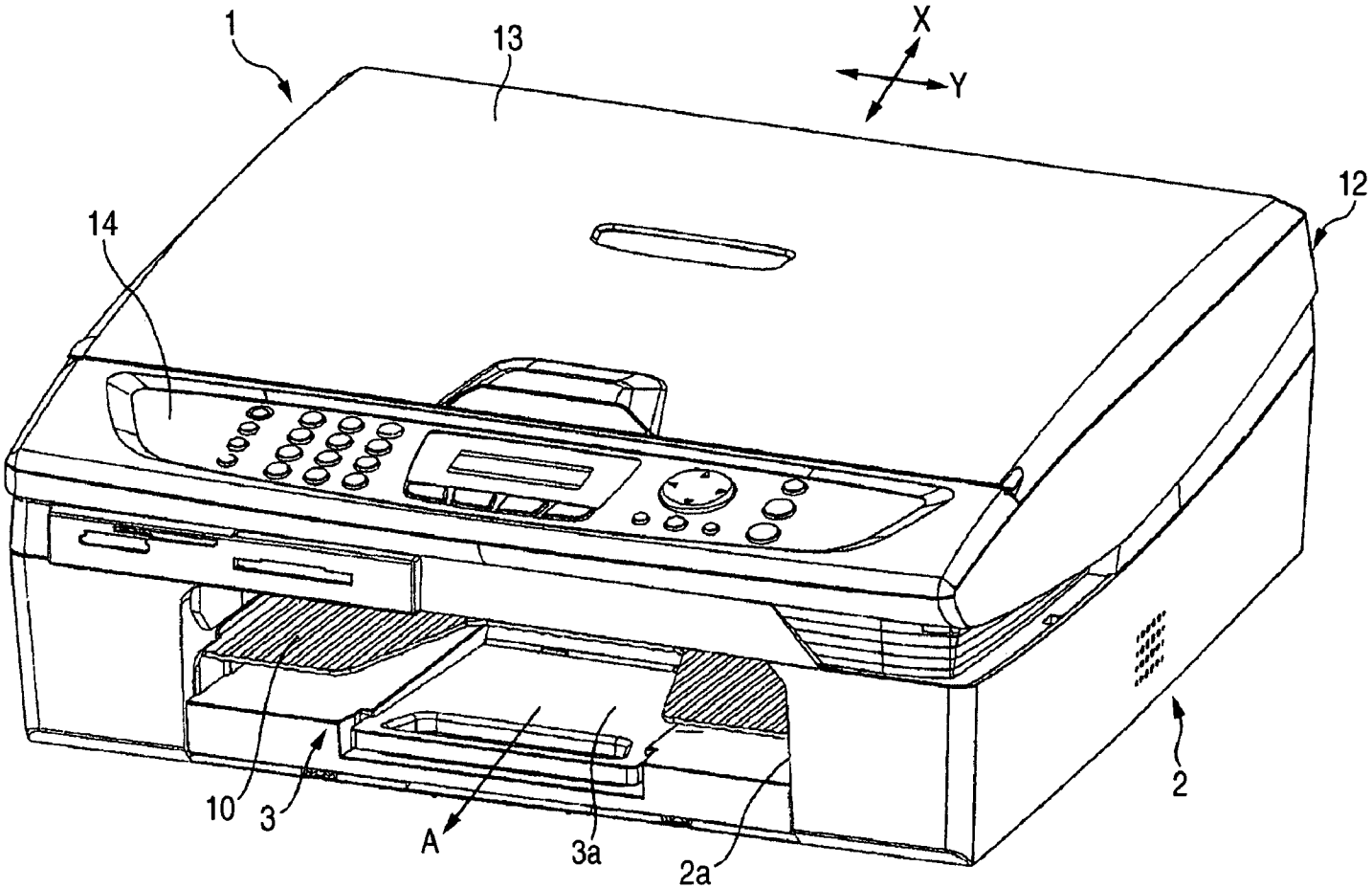
FIG. 1 is a perspective view of an image recording device according to an embodiment of the present invention.
Figure 2:
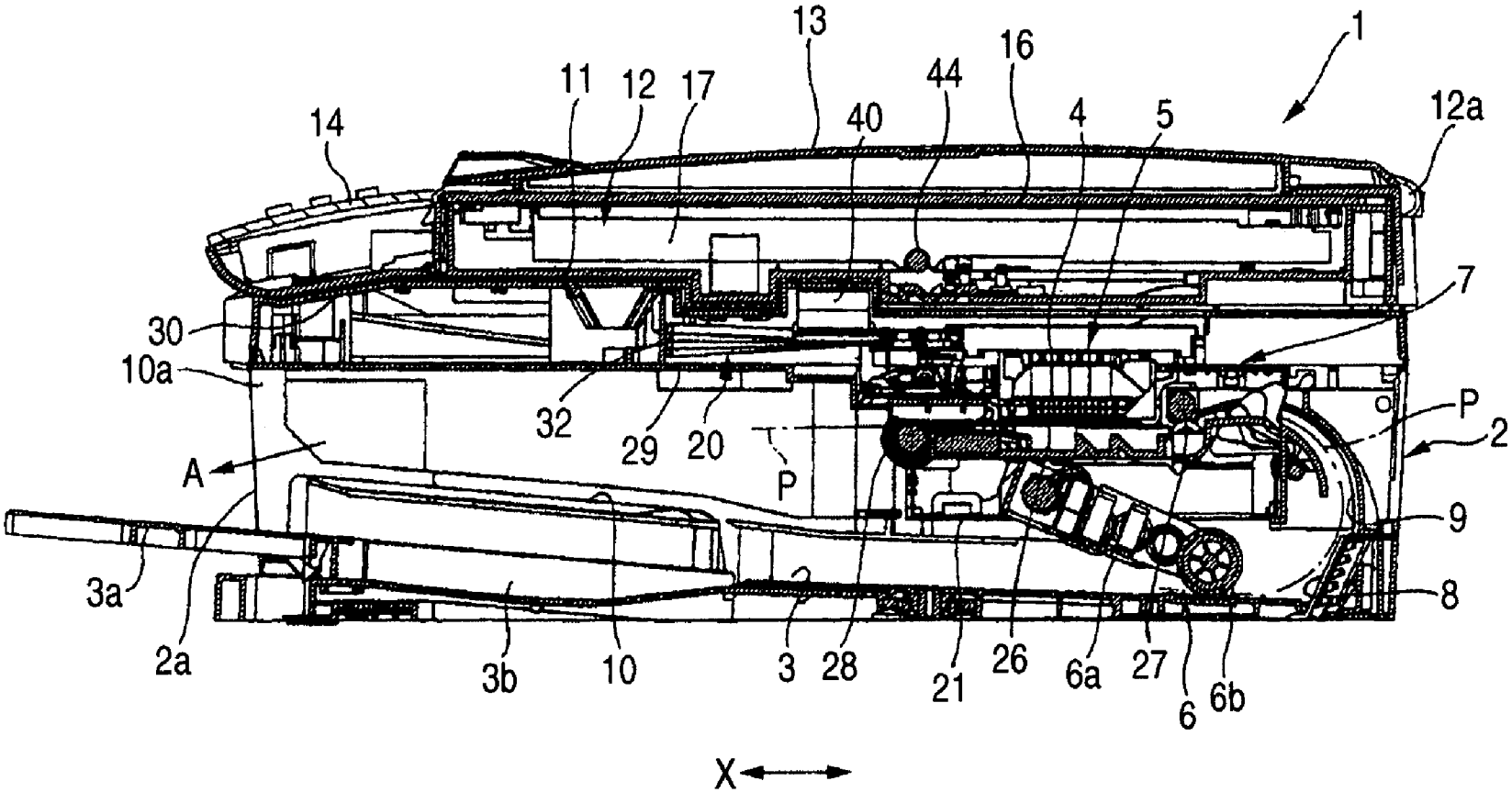
FIG. 2 is a side cross-sectional view of the image recording device.

An image recording device 1 of the embodiment is a multi function device (MFD), to which the present invention is applied, having a printer function, a copying function, a scanner function, and a facsimile function. As shown in FIGS. 1 and 2, a paper feed cassette 3 is disposed at the bottom of a housing 2, which serves as a recording device main body, made from a synthetic resin, of the image recording device 1 and which is constituted of a synthetic resin injection molded article. The paper feed cassette 3 is an example of a tray which can be inserted through an opening 2*a* disposed in the front (on the left side in FIG. 2) of the bottom section of the housing 2.

In the embodiment, the paper feed cassette 3 is assumed to have a configuration such that paper P—which is cut into, for instance, A4-size, letter size, legal size, or postcard size, and which serves as a recording medium—can be stored in such a manner that a plurality of sheets of the paper P are stacked (accumulated) with the shorter sides thereof extending in a direction (a direction perpendicular the sheet plane in FIG. 2; a main scanning direction or The direction of the Y axis) perpendicular to a paper-transport direction (a sub-scanning direction or The direction of the X axis). Meanwhile, to a front end of the paper feed cassette 3, an auxiliary support member 3*a* which supports a rear end section of elongated paper P of, for example, legal size, is attached movably along the direction of the X axis. FIG. 2 shows a state where the auxiliary support member 3*a* is disposed at a position protruding out of the housing 2. However, when paper P of A-4 size, or the like, which can be contained in the paper cassette 3 (i.e., the paper P does not protrude out of the housing 2 through the opening 2*a*) is used, the auxiliary support member 3*a* can be stored in a storage section 3*b* so as not to interfere with paper feeding.

A sloped section 8 for separating paper is disposed at a rear side (on the right side in FIG. 2) of the paper feed cassette 3. As will be described later in detail, a base portion of a paper feed arm 6*a* of a paper feed mechanism 6 is attached to a bottom plate 21*b* of a box-type main frame 21 made of a metal plate in a vertically rotatable manner. A paper feed roller (feed roller) 6*b*, disposed at a lower end of the paper feed arm 6*a*, and the sloped section 8 separate and convey, one sheet at a time, paper P which serves as a recording medium and which is stacked (accumulated) on the paper feed cassette 3. The thus-separated paper P is fed to a recording section 7 by way of a U-turn path (feed passage) 9 which is oriented laterally and moves the paper upward. The recording section 7 is disposed at a position above (at a higher position) and to the rear of the paper feed cassette 3. The recording section 7 is constituted of a carriage 5 capable of reciprocating, and the like. An inkjet-type recording head 4 for implementing a printing function, and the like, are mounted on the carriage 5.

In the embodiment, the recording section 7 serves as an image forming section that forms image on the recording medium fed by the paper feed roller 6*b*.

A paper discharge section 10 is disposed above the paper feed cassette 3, and paper P having been subjected to recording in the recording section 7 is discharged onto the paper discharge section 10 with the recorded surface facing upward. A paper discharge port 10*a* in communication with the paper discharge section 10 is opened in a common opening with the opening 2*a* on the front face of the housing 2.

An image-reading device 12 for performing document (original) reading, and the like, for a copying function and a facsimile function is disposed above the housing 2. There is employed such a configuration that a bottom wall 11 of the image-reading device 12 is superimposed on an upper cover body 30, which will be described later, from above the same with substantially no clearance there between. The image-reading device 12 is configured such that the image-reading device 12 is vertically reclosable and rotatable on one side end of the housing 2 by way of an unillustrated pivot shaft section. Furthermore, a rear end of a document cover body 13 for covering an upper face of the image-reading device 12 is attached to a rear end of the image-reading device 12 in such a manner that the document cover body 13 can vertically pivot about a pivot shaft 12*a*.

On the upper side of the housing 2, an operation panel section 14 provided with a variety of operation buttons, an LCD section, and the like, is disposed forward of the image-reading device 12. The operation panel section 14 is arranged so that the recording section 7, the paper discharge section 10, and an ink storage section 15, disposed on one side of the paper discharge section 10, are located within a projection area of the image-reading device 12 and the operation panel section 14 in the plan view. In addition, in a state where the auxiliary support member 3*a* of the paper feed cassette 3 is contained in the storage section 3*b*, length in the direction of the X axis of the paper feed cassette 3 is substantially equal to those of the image recording device 12 and the operation panel section 14. Accordingly, the image recording device 1 assumes the shape of a substantially rectangular solid which is substantially square shape in plan view. Therefore, packing for shipment as a product is facilitated, and a packaging box can also be miniaturized.

Figure 3:
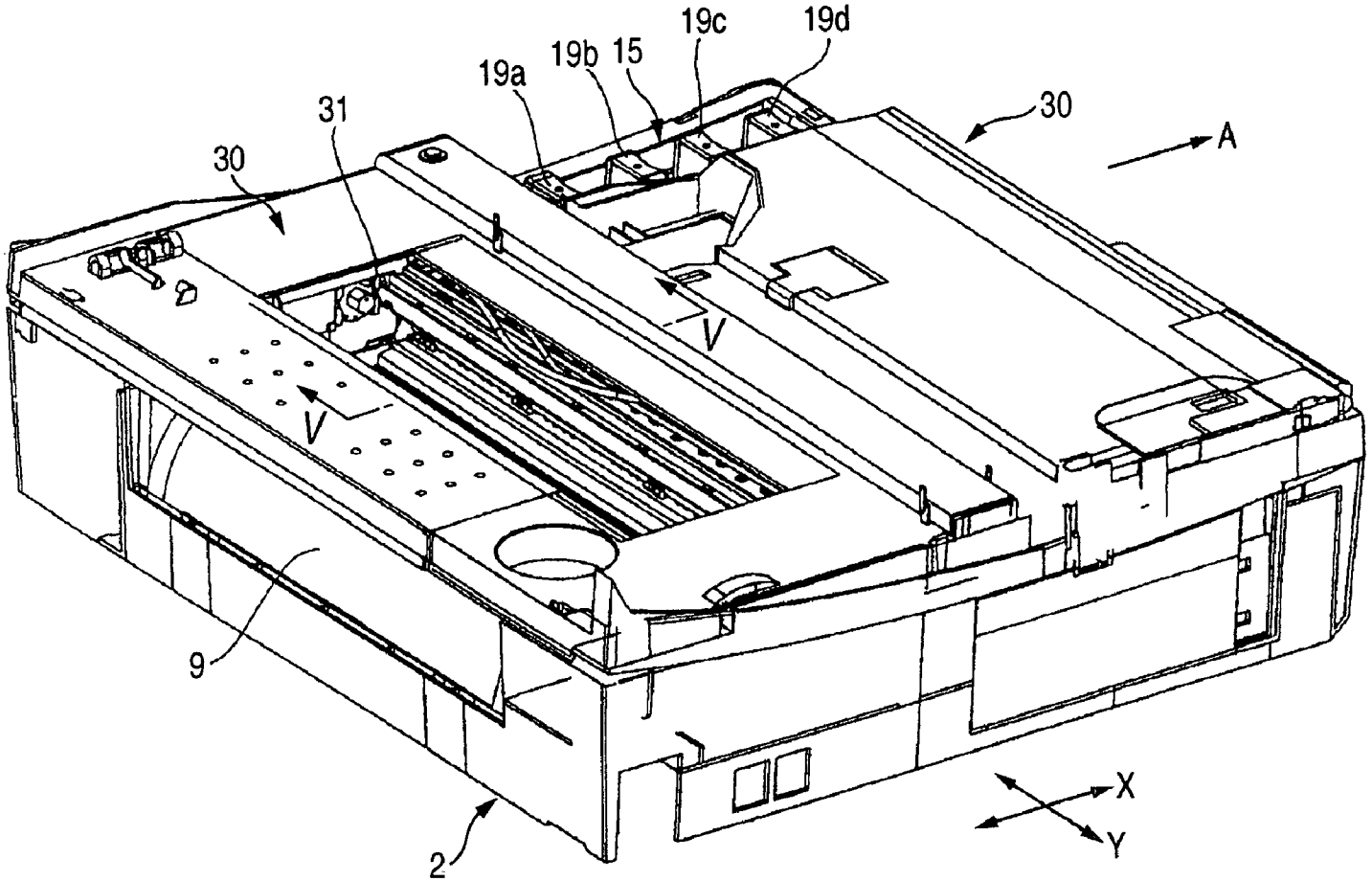
FIG. 3 is a perspective view of a recording device main body.

On the upper surface of the image-reading device 12, there is disposed a document glass plate 16 on which a document can be placed after the document cover body 13 is opened upward. An image scanner device (CIS: contact image sensor) 17 for reading the document is disposed below the document glass cover 16 so as to allow reciprocation along a guide shaft 44 extending in a direction (the main-scan direction, and The direction of the Y axis in FIGS. 1, 3, and 4) perpendicular to the sheet plane in FIGS. 2, 5, and 6.

The ink storage section 15 is open upward of the housing 2, and can store ink cartridges 19 in a column alignment along the direction of the X axis. The ink cartridges 19 contain four color inks for full-color recording, is small in area in its plan view, and is of a substantially rectangular box shape which is large in height (cartridges of respective colors; that is, of black (BK), cyan (C), magenta (M), and yellow (Y), are denoted by reference numerals 19*a* to 19*d*; see FIGS. 3 and 4).

Figure 5:
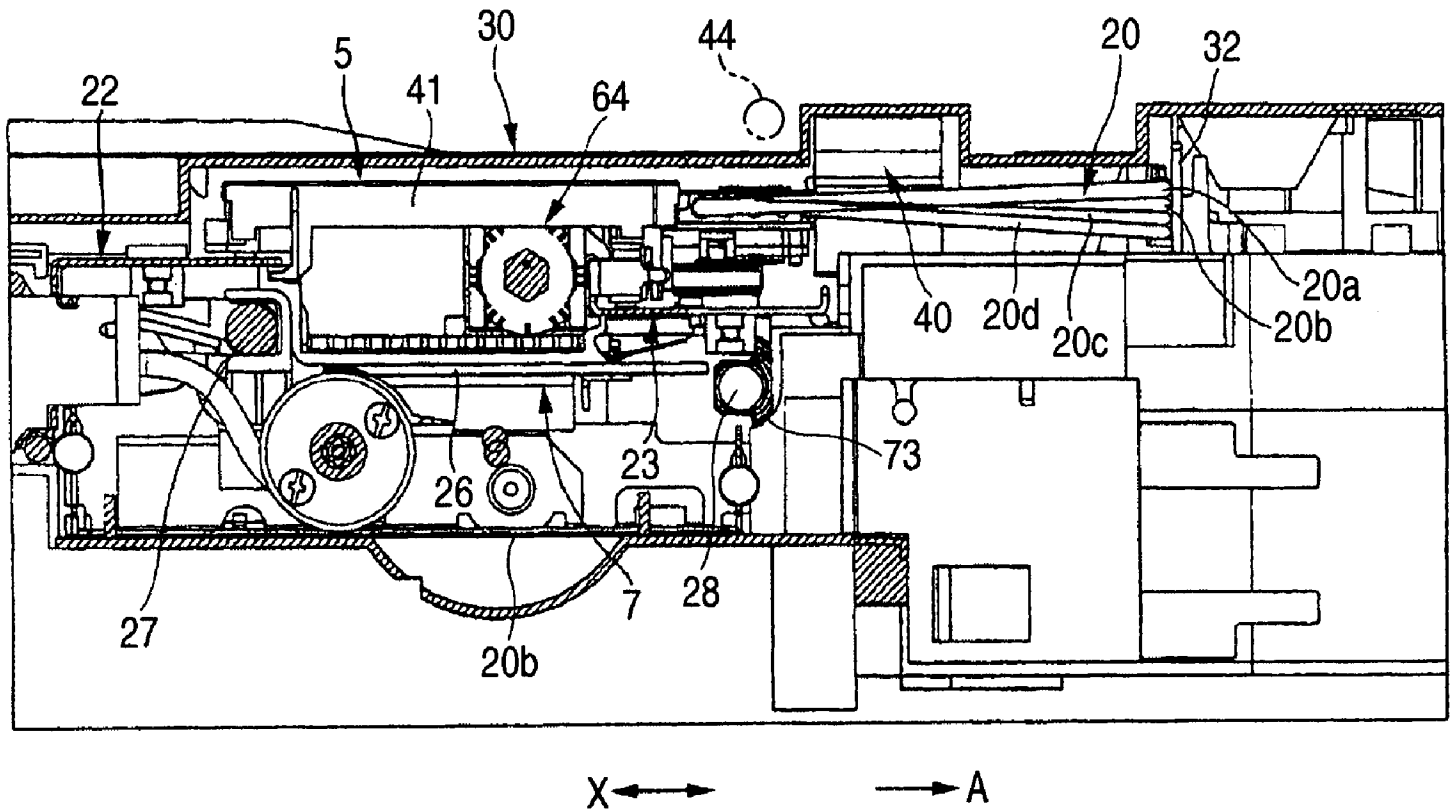
FIG. 5 is an enlarged side cross-sectional view taken along line V-V in FIG. 3.

Such a configuration is employed that ink is supplied from the respective ink cartridges 19 (independently, denoted by reference numerals 19*a* to 19*d*) to the inkjet-type recording head 4 by way of a plurality of (in the embodiment, four) ink supply tubes (ink tubes) 20 (independently, denoted by reference numerals 20*a* to 20*d*; see FIG. 5). Meanwhile, when a greater number of ink colors (six to eight colors) than four colors is employed, the ink storage section 15 may be configured so as to be able to contain ink cartridges of the number corresponding to the number of ink colors; and the ink supply tubes may also be increased in number in accordance with the number of ink cartridges.

An ink receiving section 38 is provided in a position on one end (a location which is close to a left side plate 21*a* in FIG. 7 in the present embodiment) outside the width (a shorter side of the paper P) of the transported paper P. Further, a maintenance unit 50 serving as maintenance means to be described later is provided on the other side (a location close to a right side plate 21*a* in FIG. 7). By means of these elements, the recording head 4 periodically ejects ink for preventing clogging of nozzles in a flushing position set in the ink receiving section 38 during the course of recording operation, and the elected ink is received by the ink receiving section 38. A standby position for the carriage 5 is set in the maintenance unit 50, and a cap section 50*a* of the maintenance unit 50 covers a nozzle surface of the recording head 4 from below to thus selectively suck ink on a per-color basis and to perform recovery processing, or the like, for removing air bubbles in an unillustrated buffer tank provided on the recording head 4. When the carriage 5 laterally approaches the maintenance unit 50, cleaning operation is performed for wiping the nozzle surface with an unillustrated cleaner (a wiper blade).

Figure 7:
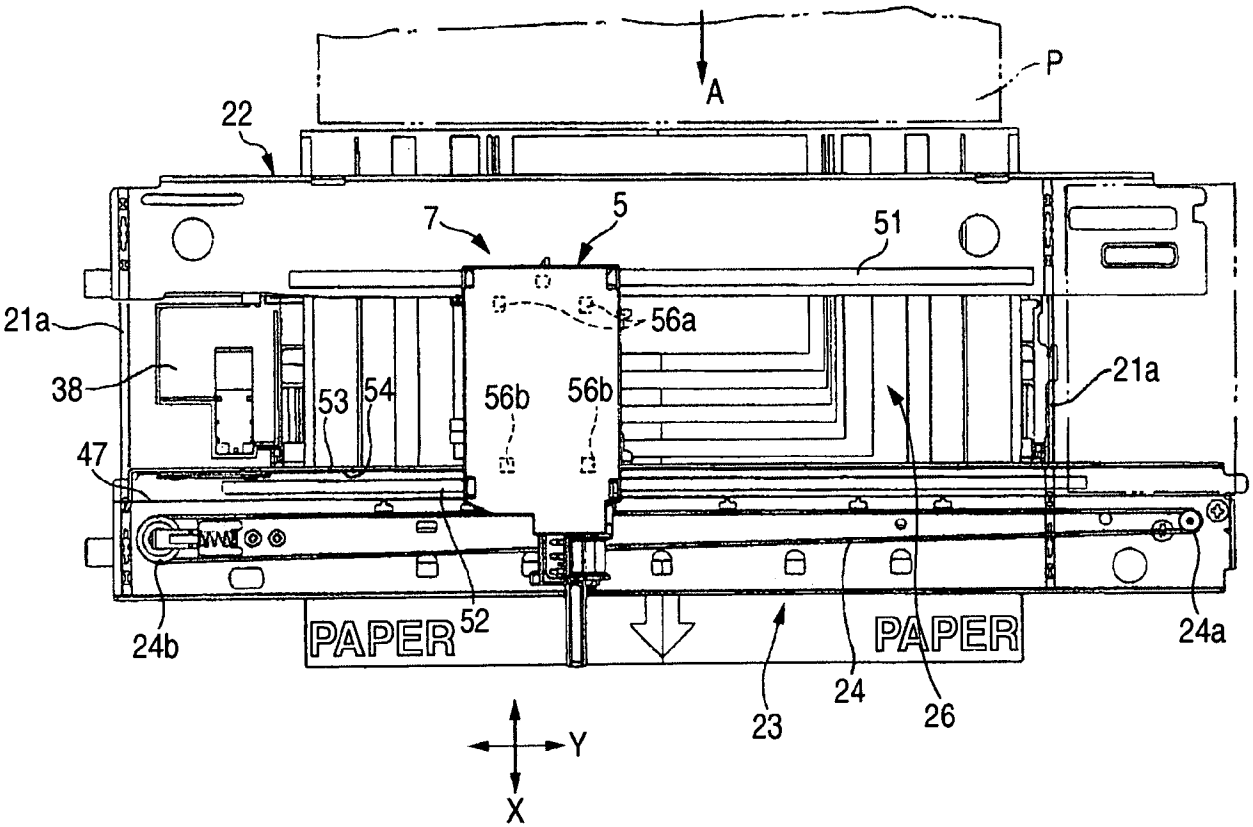
FIG. 7 is a plan view of a recording section.
Figure 8:
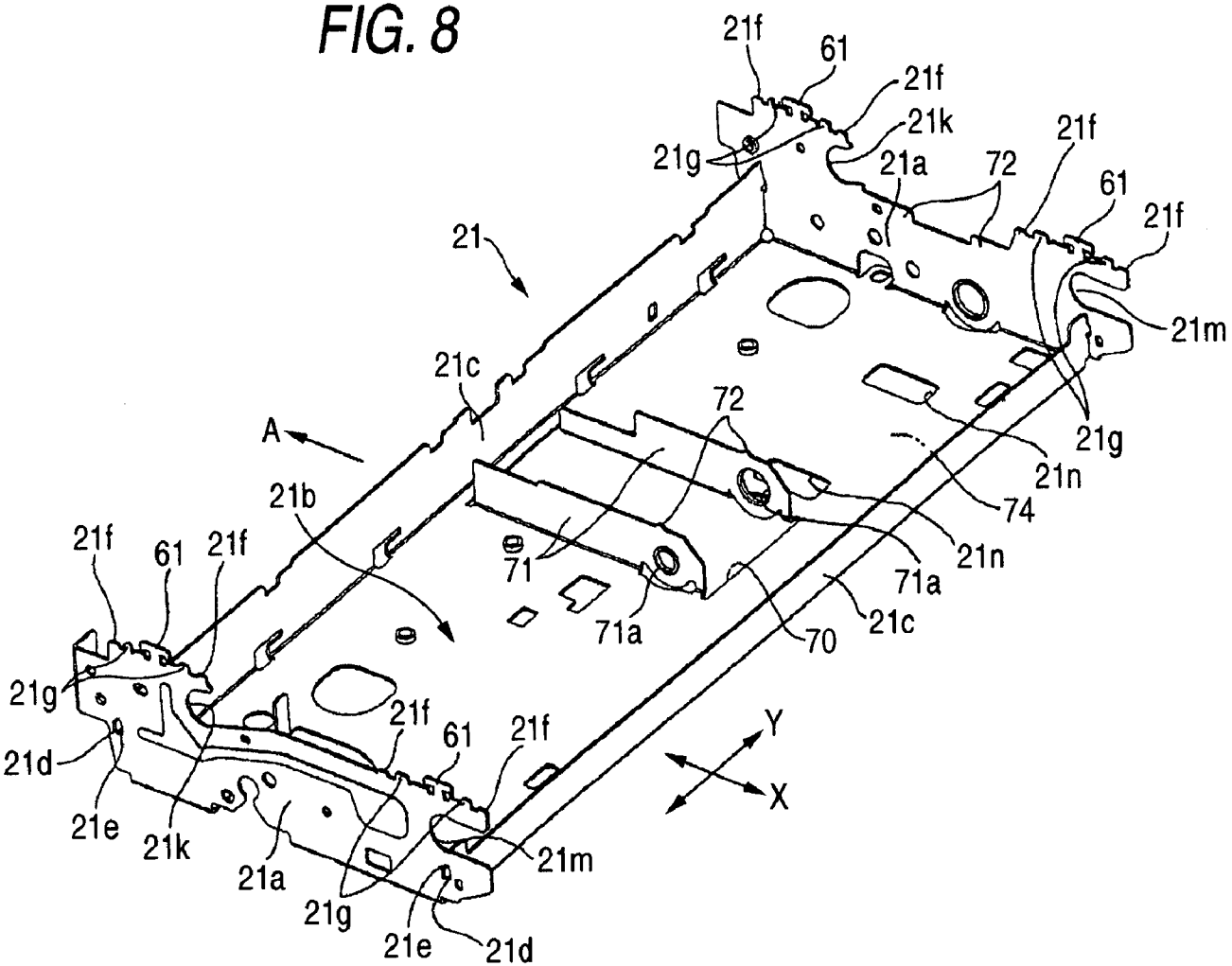
FIG. 8 is a perspective view of a main frame.
Figure 9:
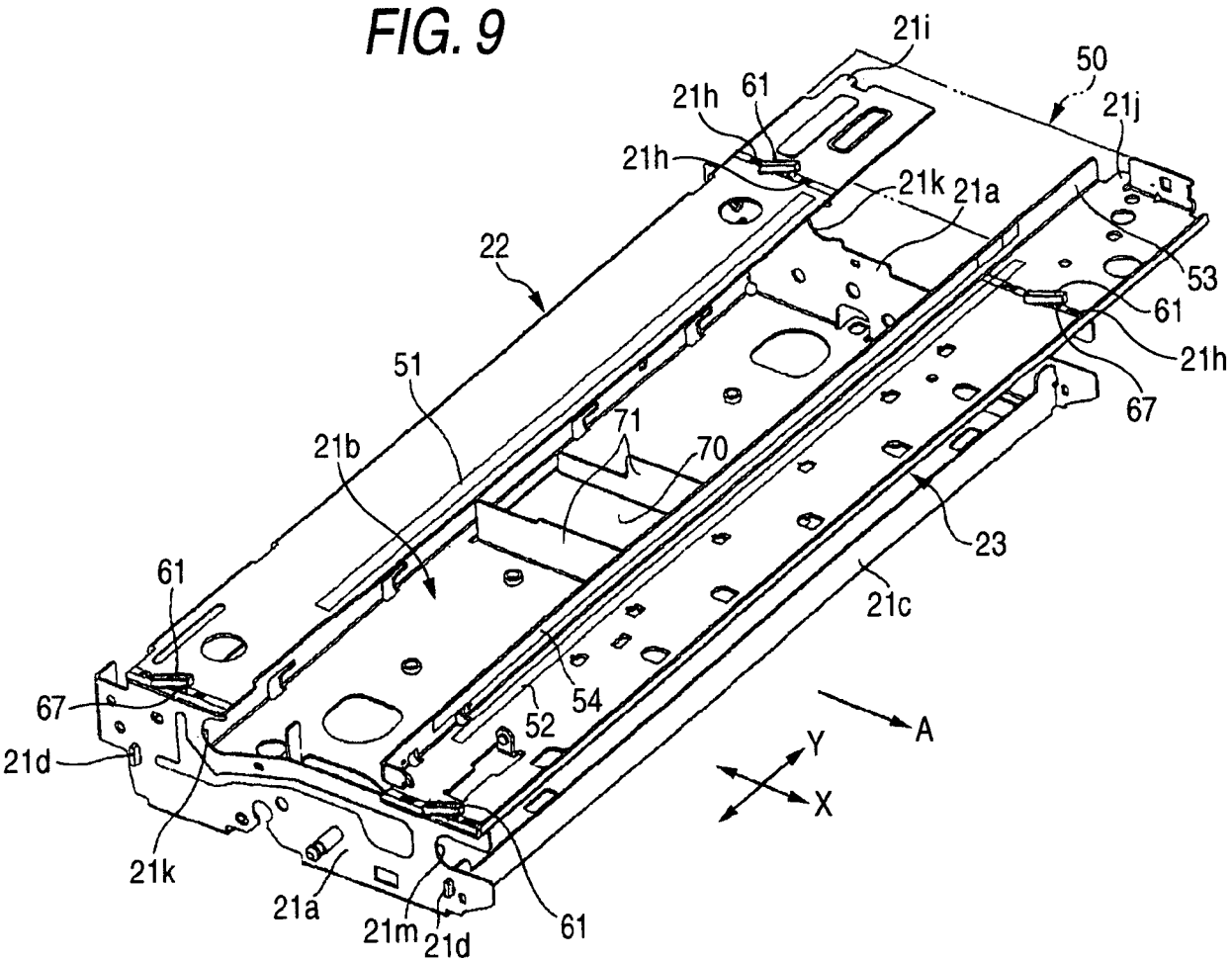
FIG. 9 is a perspective view of a state where two guide members are attached to the main frame.

As shown in FIGS. 7 to 9, the recording section 7 is supported by the box-shaped main frame 21 and the pair of right and left side plates 21*a* and formed between plate-like first and second guide members 22, 23 which extend in the direction of the Y axis (the main scanning direction).

With reference to FIGS. 7 to 9, there will now be described the structure of the main frame 21 and the structure for mounting the upstream guide member (the first guide member) 22 and the downstream guide member (the second guide member) 23 in a paper transport direction. As shown in FIG. 8, the main frame 21 is formed by means of: punching a sheet of metal plate (steel plate) into a predetermined shape; and bending a pair of side plates 21*a* and a pair of reinforcing plates 21*c* with reference to a bottom plate 21*b* so as to assume the shape of an upwardly-open box. Accordingly, the assembly operation becomes considerably simple. The pair of side plates 21*a* are formed by upwardly bending both ends of the bottom plate 21 in the longitudinal direction thereof (i.e., both ends of the bottom plate 21 in the direction of the Y axis) so as to stand upright. The pair of reinforcing plates 21*c* are formed by upwardly bending both ends of the bottom plate 21*b* in the lateral direction thereof (i.e., both ends of the bottom plate 21 in the direction of the X axis) so as to stand upright. Projections 21*d* (the projections 21*d* provided only on one side of the respective reinforcing plates 21*c* are shown in FIG. 8) provided on both ends of the pair of reinforcing plates 21*c* are fitted into holes 21*e* formed in the respective side plates 21*a* (see FIGS. 8 and 9). A plurality of positioning protrusion sections 21*f* and T-shaped latching claws 61 are upwardly formed integrally on upper end faces of the respective side plates 21*a* for horizontally supporting lower surfaces of the horizontal plates of the first and second guides 22, 23 and defining the height positions of the horizontal plates (by extension, the height positions and levelness of first slide surfaces 51, 52, which will be described later) (see FIG. 8 and like drawings). Slit-shaped latching holes 67 into which the latching claws 61 can be inserted are formed in the horizontal plates of the first and second guide members 22, 23. After the respective latching claws 61 have been fitted into the corresponding latching holes 67, the upper ends of the respective latching claws 61 are twisted right or left, whereby the latching claws 61 are fixedly crimped in a unremovable manner while the lower surfaces of the latching claws 61 remain in contact with the upper surfaces of the respective horizontal plates (see FIG. 9). As mentioned above, the latching claws 61 are twisted or bent while being fitted into the respective latching holes 67, to thus fix the respective guide members 22, 23 to the main frame 21. As a result, the assembly operation becomes considerably simple, and the number of parts is maintained small.

At this time, a pair of projection sections 21*g* projecting from the upper end face of each side plate 21*a* with the latching claw 61 sandwiched there between (see FIG. 8) are fitted into positioning holes 21*h* adjacent to the latching holes 67 (see FIG. 9), thereby defining parallelism and an interval, which is orthogonal to the parallel direction, between the first and second guide members 22, 23. By means of such a configuration, the structure into which the main frame 21 and the two guide members 22, 23 are assembled assumes a box shape and has rigorous stiffness.

The carriage 5—on which is mounted the recording head 4—is slidably supported (mounted) so as to straddle the upstream guide member 22 and the downstream guide member 23 with respect to the paper transport direction, and becomes able to reciprocate. A first slide surface 51 parallel to the lower surface of the recording head 4 of the carriage 5 (i.e., the head surface where the nozzle is formed) is formed in an area on the upper surface of the guide member 22 close to the carriage 5. A first slide surface 52 parallel to the lower surface of the same is formed in an area on the upper surface of the guide member 23 close to the carriage 5.

A guide piece 53 is formed by upwardly bending, into a substantially perpendicular position, an upstream portion of the downstream guide member 23 with respect to the paper transport direction, and a second slide surface 54 which faces downstream in the paper transport direction is formed (see FIGS. 7 and 9).

As shown in FIG. 9, the right ends of the first and second guide members 22, 23 extend rightward beyond the right side plate 21*a*. The maintenance unit 50 is situated so as to straddle an area between the projecting portions of the first and second guide members 22, 23 and the right side plate 21*a*. In order to mount the maintenance unit 50, tongued tabs 21*i*, 21*j* serving as attachment sections are caused to project rightward from the right ends of the horizontal plates of the first and second guide members 22, 23. These tongued tabs 21*i*, 21*j* are horizontally inserted into and fittingly positioned in the latching holes of the maintenance unit 50.

An opening section 70 which can house the paper feed arm 6*a* and the paper feed roller 6*b* of the paper feed mechanism 6 is formed in the bottom plate 21*b* of the main frame 21. A pair of shaft support plates 71 are upwardly formed on both sides of the opening section 70 so as to stand upright, by means of cutting and bending. Shaft holes 71*a* which enable rotatray support of base end portions of the paper feed arm 6*a* are formed in the respective shaft support plates 71 (see FIG. 8). In order to define the height position of the oblate platen 26, which extends in the direction of the Y axis so as to oppose the lower surface of the recording head 4 of the carriage 5, projections 72 are provided on the upper end of the pair of shaft support plates 71 as well as on one side plate 21*a* (the right side plate 21*a* in FIG. 8) (see FIGS. 6 and 8). By virtue of the projections, the dimension of clearance existing between the upper surface of the platen 26 attached to the main frame 21 and the lower surface of the recording head 4 (clearance which enables passage of the paper P) can be defined accurately.

The carriage 5 whose upper surface is provided with a removable cover member 41 has first slidable projection sections 55*a*, 55*b* and a plurality of removal prevention claws 56*a*, 56*b*. The first slidable projection sections 55*a*, 55*b* protrude from the lower surface of the carriage 5 and come into contact with the first slide surfaces 51, 52 of the guide members 22, 23. The plurality of removal prevention claws 56*a*, 56*b* are arranged so as to catch the first and second guide members 22, 23 in conjunction with the first slidable projection sections 55*a*, 55*b*.

In the embodiment, the first slide projection section 55*a* which comes into contact with the first slide surface 51 of the first guide member 22, is disposed in substantially the center of the carriage 5 with respect to the horizontal direction thereof (the main scanning direction). The two first slide projections 55*b*, which come into contact with the first slide surface 52 of the second guide member 23, are spaced apart from each other, as required, in the horizontal direction (the main scanning direction). The two removal prevention claws 56*a* and the two removal prevention claws 56*b* are provided on respective sides so as to face the lower surfaces of the first and second guide members 22, 23. The first slide projection sections 55*b* and the removal prevention claws 56*a*, 56*b* are provided in the vicinity of the lateral ends of the carriage 5 when viewed from the top (see FIG. 7).

The three first slide projections 55*a*, 55*b*, and 55*b* are arranged in a triangular pattern (preferably an isosceles triangle) on the carriage 5 when viewed from the top, whereby the carriage 5 is stably supported by the first and second guides 22, 23. With a view toward causing the first slide projection sections 55*a*, 55*b* to slide briskly while receiving the weight of the carriage 5 in place of the guide members 22, 23, a plurality of recessed grooves (not shown)—which hold lubrication grease and extend long in the direction of the X axis—are formed in the lower surfaces (the support surfaces or slide surfaces) of the first slide projections 55*a*, 55*b* while being spaced at appropriate intervals, in the main scanning direction (the direction of the Y axis).

A second slide projection section (not shown) which is to brought into contact with the second slide surface 54 of the second guide member 23 is provided at two locations. One of the second slide projection sections is formed integrally with a holder case of the carriage 5.

The other second slide projection section and a nipping piece (neither of which is shown in the drawings) are provided by way of attitude adjustment means 64 for adjusting the attachment attitude of the carriage 5 on the guide piece 53 which is perpendicular to the second guide member 23. The other second slide projection section and the nipping piece can change or adjust the attitude of the carriage 5 around the location where a slide surface of the first slide projection section remains in contact with the guide piece 53 when viewed from the top.

In order to reciprocally actuate the carriage 5 with the recording head 4 mounted thereon, a timing belt 24 is disposed on the upper surface of the guide member 23 located downstream in the paper transport direction (the direction of arrow A) so as to extend in the main scanning direction (the direction of the Y axis), and the timing belt 24 is passed around pulleys 24*a*, 24*b*. A CR (carriage) motor (although the carriage motor is not shown and is embodied as a DC motor in the embodiment, another motor, such as a stepping motor, may also be employed) for driving the timing belt 24 is fastened to the lower surface of the second guide member 23. The second guide member 23 is equipped with an encoder strip 47, or the like, which is disposed in the vicinity of the guide piece 53 so as to extend in the main scanning direction and is intended for detecting the position of the carriage 5 in the direction of the Y axis (the main scanning direction). This belt-like encoder strip 47 is disposed such that an inspection surface (a face in which slits are formed at given intervals in the direction of the Y axis) of the strip is aligned in the vertical direction.

The arrangement and structure of the flexible ink supply tube 20 that couples the respective ink cartridges 19 housed in the ink storage section 15 with the recording head 4 in the recording section 7 will now be described.

In the embodiments, respective ink supply tubes 20*a* to 20*d* are mutually-independent tube members, and the ink supply tubes 20*a* to 20*d* are used while being made equal in length to each other.

Figure 4:
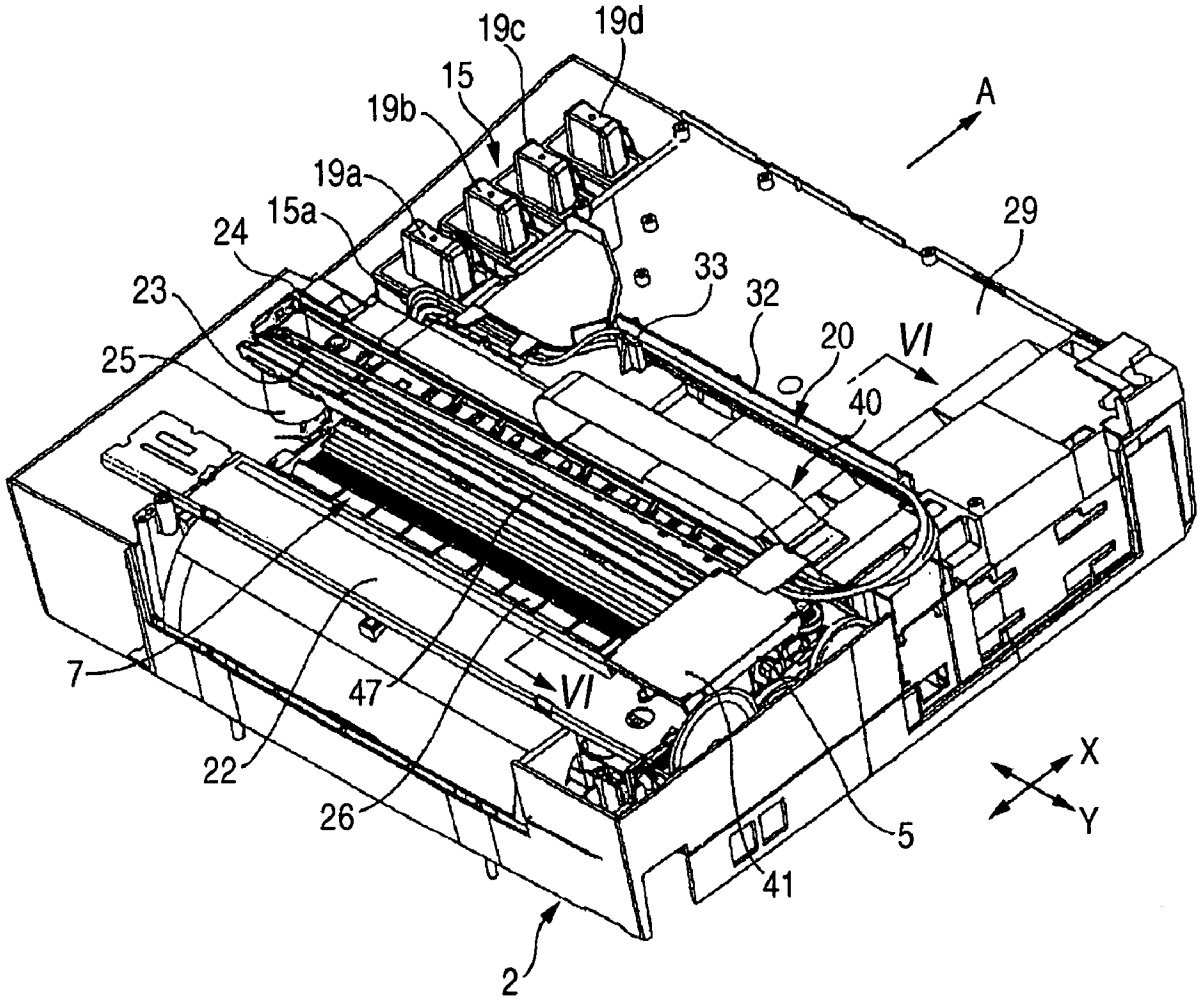
FIG. 4 is a perspective view of the recording device main body, showing a state where an upper cover body is removed.

As shown in FIGS. 4 and 5, base portions of the plurality of the ink supply tubes 20 (four tubes in the embodiment) are bundled at one end 15*a* of the ink storage section 15 and stretched over the upper surface of a lower cover member 29 from one end (the right end in FIG. 4) to the other end (the left end in FIG. 4) in the direction of the Y axis. At this time, the base portions of all the ink supply tubes 20*a* to 20*d* are arranged in a lateral line over the upper surface of the substantially-horizontal lower cover member 29. At least portions (intermediate portions or the like) of the ink supply tubes 20 are supported by the upper surface of the lower cover member 29.

Next, all of the ink supply tubes 20*a* to 20*d* are twisted such that the intermediate portions of the supply tubes run over one vertical surface (substantially-perpendicular surface) of a vertical partition 32. The intermediate portions of all the ink supply tubes 20*a* to 20*d* are arranged in a vertical line and fixed (shrouded or sandwiched) between the one vertical surface of the vertical partition 32 and a fixing member 33 which is fastened with screws so as to oppose the one vertical surface, is made of synthetic resin, and assumes the shape of a vertical plate. The area where all of the ink supply tubes 20*a* to 20*d* are fixed (shrouded) between the fixing member 33 and the one vertical surface of the vertical partition 32 becomes an intermediate fixed section.

The carriage 5 is provided with a joint piece extending in substantially a horizontal direction downstream of the paper transport direction (the direction of arrow A). While being arranged in a substantially horizontal line, tip ends of all the ink supply tubes 20*a* to 20*d* are connected to a connection section provided on the left end of the joint piece in FIG. 4. Within the area from the intermediate fixed section (the fixing member 33) to the connection section, the orientation of the intermediate sections of all of the ink supply tubes 20*a* to 20*d* is changed from left to right, and the ink supply tubes are twisted and pulled such that phases of lines (arrangements) of all the ink supply tubes 20*a* to 20*d* are changed from the substantially vertical direction at the intermediate fixed section (the fixing member 33) to a substantially horizontal direction at the connection section. As a result, all the ink supply tubes 20*a* to 20*d* are easily integrated together while the respective ink supply tubes 20*a* to 20*d* are curved independently of each other. As a matter of course, all the ink supply tubes 20*a* to 20*d* are independently separated from each other within the area from the intermediate fixed section (the fixing member 33) to the connection section.

In the embodiment, a command signal for causing the nozzles of the recording head 4 mounted on the carriage 5 to selectively eject ink droplets is transmitted from an unillustrated control section provided in the housing 2 by way of a flexible flat cable 40. The flexible flat cable 40 is laid in an area (a movable area, or an unbundled/unrestrained area) where the ink supply tubes 20*a* to 20*d* run when the carriage 5 travels reciprocally in the direction of the Y axis (the main scanning direction), in substantially parallel to the direction in which the ink supply tubes 20 extend (see FIGS. 4 and 5).

The curving direction of the intermediate curved portions of the ink supply tubes 20 is set so as to be opposite to the curved direction of the intermediate curved portion of the flexible flat cable 40 with respect to the direction of reciprocal movement of the carriage 5. By means of this arrangement, the ink supply tubes 20 and the flexible flat cable 40 can be arranged essentially flush with each other (within an essentially identical horizontal plane) with respect to the perpendicular direction. Consequently, the overall image recording device 1 can be rendered slim.

Shaft support sections (attachment sections) 21*k* are for supporting both ends of a pair of registration roller (transport rollers) 27 which are disposed upstream of the transport direction with the platen 26 interposed there between and feed the paper P toward the lower surface of the recording head 4. Shaft support sections (attachment sections) 21*m* are for supporting both ends of a paper discharge roller 28 which is disposed downstream of the platen 26 and transports the recorded paper P toward the paper discharge section 10. The shaft support sections 21*k* and 21*m* are formed in the pair of side plates 21*a* of the main frame 21 in a notched manner (see FIGS. 8 and 9). By means of this configuration, the axes of the resist rollers 27 and the axis of the paper discharge roller 28 are aligned horizontally and enable accurate determination of attachment positions.

Figure 6:
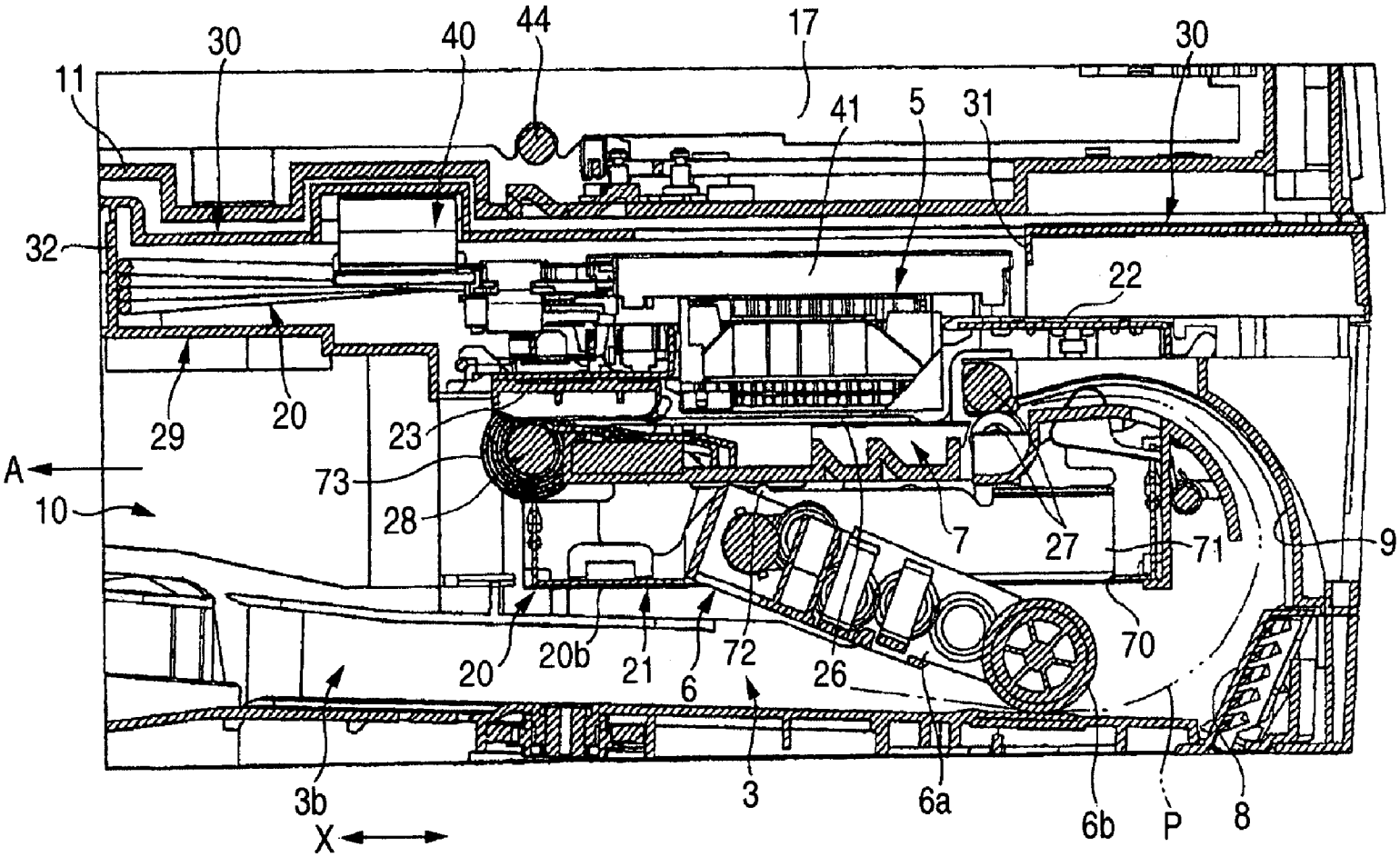
FIG. 6 is an enlarged side cross-sectional view taken along line VI-VI in FIG. 4.
Figure 11:
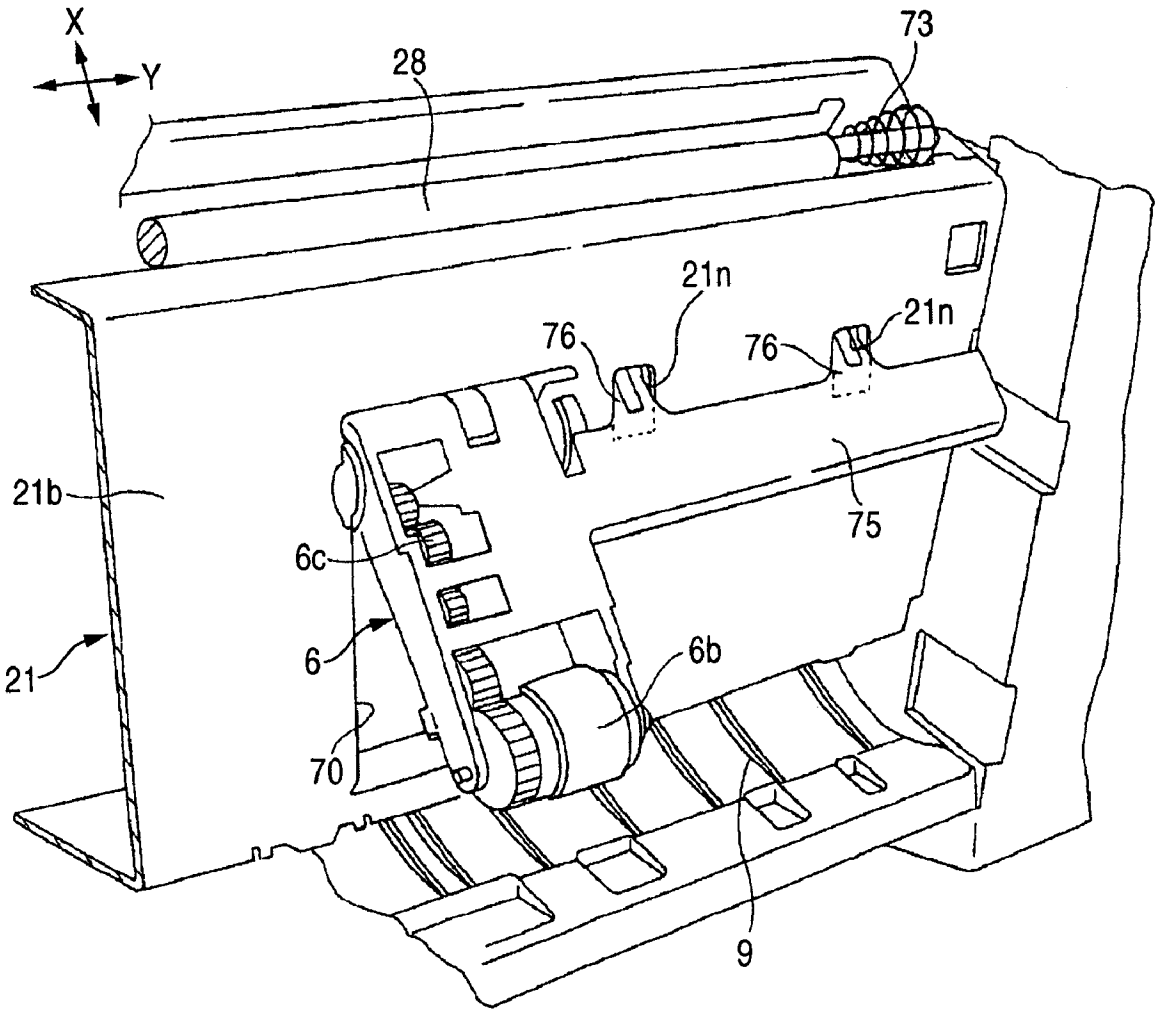
FIG. 11 is a perspective view of a state where a paper feed arm is exposed from the main frame.
Figure 20:
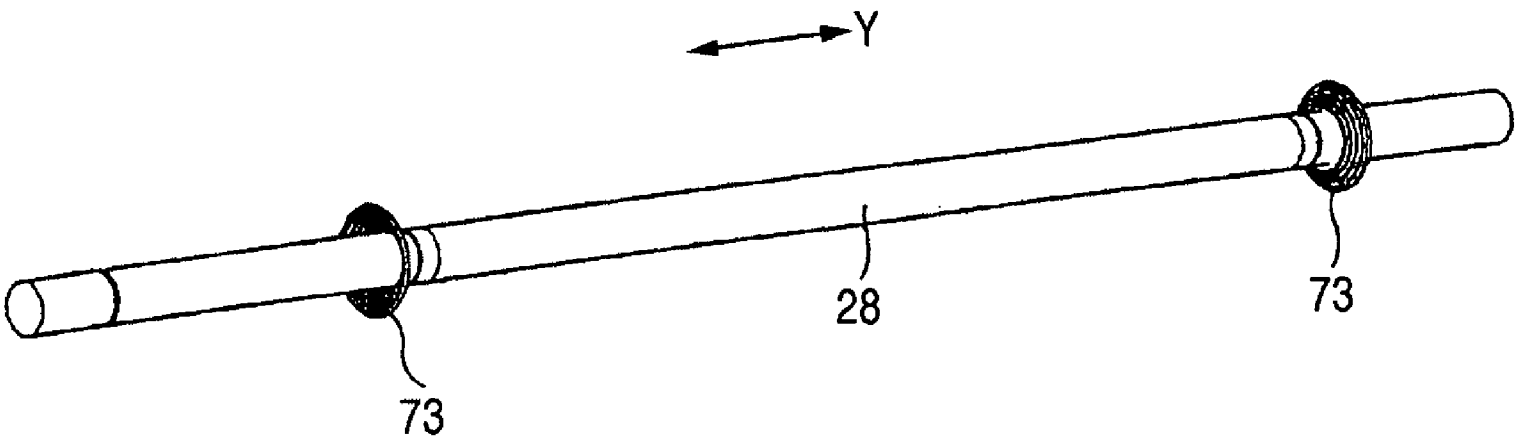
FIG. 20 is perspective view of a paper discharge roller and guide members.

As shown in FIG. 20, guide members 73 are provided on respective sides of the paper discharge roller 28, wherein each of the guide members 73 is formed by winding a fine line into a truncated conical shape such that the diameter of the wound cone becomes gradually smaller toward the center of the paper P in the widthwise direction thereof (only one of the guide members 73 is shown in FIGS. 6 and 11). Although not illustrated, spur wheels which come into contact with the upper surface of the paper P are disposed at positions which are closer to the center of the paper P in the widthwise direction thereof than are the positions of the guide members 73 and which are higher than the paper discharge roller 28. As a result, when the recorded paper P is discharged while passing between the spur wheels and the paper discharge roller 28, side edges of the paper P in the direction of the X axis are warped upwardly by means of the pair of guide members 73. Accordingly, the paper P is discharged while being held essentially in the shape of the letter U. Therefore, the paper P is discharged straightforward in the transport direction (the direction of arrow A) without drooping downward, and is placed on the paper discharge section 10 after having left the paper discharge roller 28. This configuration enables securing of a time to dry the ink on the previously-recorded paper P.

A partition (lower cover member) 29 made of synthetic resin is provided so as to cover the space above the paper discharge section 10 from the lower surface of the guide member 23 located downstream of the paper transport direction to the paper discharge port 10*a* located at the front edge of the housing 2, at a position which is essentially on the same level with the bottom plate 21*b* of the main frame 21. The partition 29 is formed integrally with the housing 2 (see FIGS. 6 and 10).

An upper cover 30 is disposed so as to be appropriately spaced apart above from the partition (lower cover member) 29 and to cover the space above the carriage 5 and the reciprocal travel path thereof. A rectangular window hole 31 is formed in an intermediate portion of the upper cover member 30 so as to enable acquisition of a view of the reciprocal travel path of the carriage 5 from above (see FIG. 3). When the paper P has caused a jam in the recording section 7, the user can remove the paper P from this window hole 21 by rotating the image-reading device 12 by way of the housing 2. In this case, the ink supply tubes 20 are not pulled above the platen 26, thereby facilitating removal of the paper P is facilitated.

Figure 12:
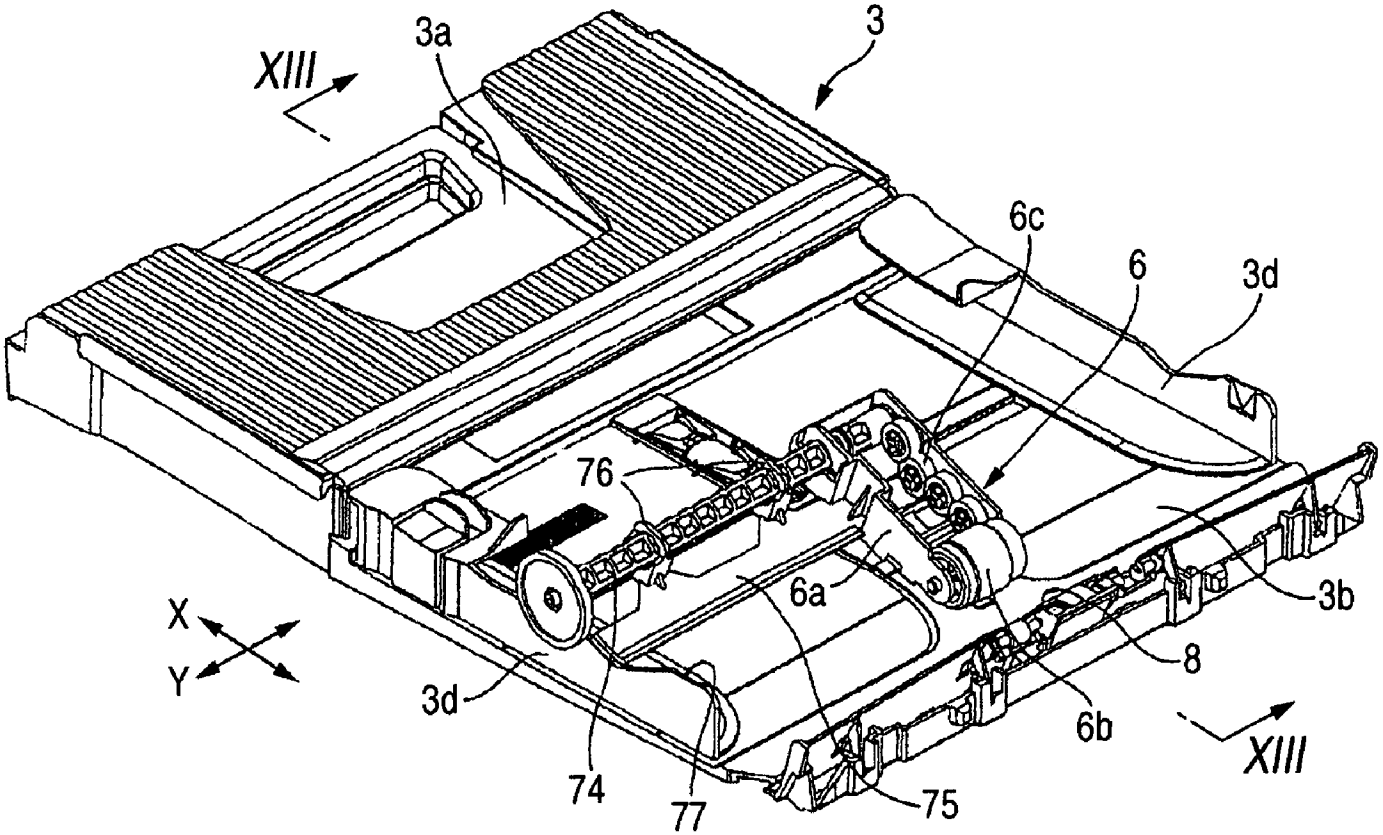
FIG. 12 is a perspective view of a paper feed cassette and the paper feed mechanism.
Figure 17:
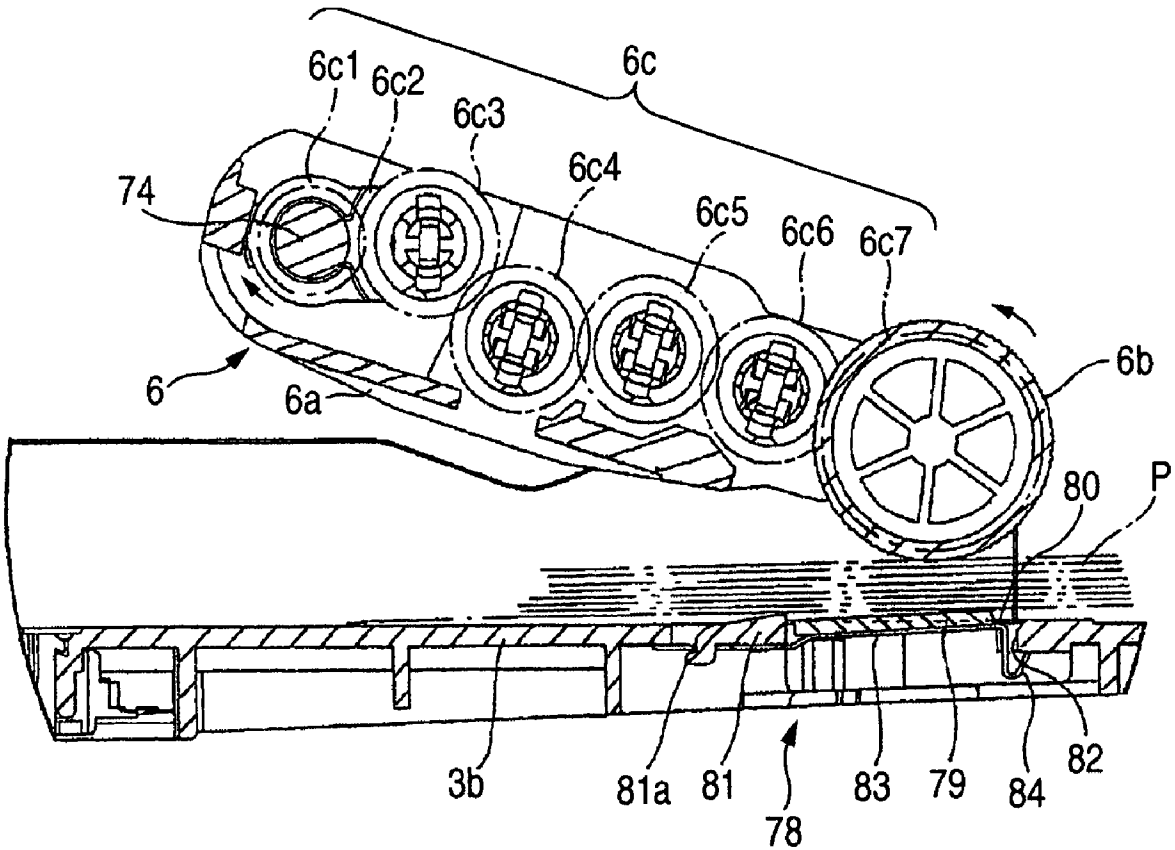
FIG. 17 is a partially enlarged side cross-sectional view for explaining feeding in a state where paper is stacked.

The configuration of the paper feed mechanism 6 and that of the paper feed cassette 3 will now be described. The drive shaft 74 which is made of synthetic resin and shown in FIG. 12 is rotatably supported by the shaft holes 71 formed in the side plates 21*a* of the main frame 21 shown in FIG. 8 and the pair of respective support plates 71. The tip ends of the drive shaft 74 are inserted into the base portion of the paper feed arm 6*a* of the paper feed mechanism 6 so as to protrude horizontally. The base end portion of the paper feed arm 6*a* is located within the opening section 70 formed in the bottom plate 21*b*. Accordingly, the paper feed arm 6*a* is arranged concentrically with respect to the shaft holes 71*a* of the pair of shaft support plates 71, and the drive shaft 74 is rotatably supported by the shaft holes 71*a* of the same. The paper feed roller 6*b* is rotated in a given direction by way of a gear transmission mechanism 6*c* provided within the paper feed arm 6*a* by means of rotational driving action of the drive shaft 74. As shown in FIGS. 12 and 17, the gear transmission mechanism 6*c* is pivotally supported by a gear 6*c*1 which rotates in conjunction with the drive shaft 74 and by the tip end of a planetary arm 6*c*2 rotatably fitted around the drive shaft 74. The gear transmission mechanism 6*c* is constituted of a planetary gear 6*c*3 meshing with the gear 6*c*1, and a plurality of intermediate gears 6*c*4, 6*c*5, and 6*c*6 (three in the embodiment) for transmitting power from the planetary gear 6*c*3 to a gear 6*c*7 formed on the side of the paper feed roller 6*b*.

The portion of the gear transmission mechanism 6*c* close to the paper feed roller 6*b* is always forced downward below the bottom plate 21*b* by means of unillustrated urging member (e.g., a torsion spring).

Multiple sheet feed prevention member 78 will now be described. During a period in which the paper feed roller 6*b* serving as a rotary feed member feeds, toward a U-turn path 9, the paper P loaded on the bottom plate 3*b* of the paper feed cassette 3 which is made of synthetic resin and is an example of the tray feed, the multiple sheet feed means 78 retains the paper P to be fed finally within the paper feed cassette 3. The multiple sheet feed prevention member 78 in the recording medium feeder includes a base pad (a first friction member) 79 which is disposed on the bottom plate 3*b* of the paper feed cassette 3 opposing the paper feed roller 6*b* and is formed from cork having a high friction coefficient; and a base plate 80 which serves as a member of low friction coefficient (a second friction member) and is made from a plate of metal such as stainless steel.

The base plate 80 has low friction coefficient that is lower than the friction coefficient of the base pad 79. That is, the base plate 80 indicates lower friction coefficient than that of the base pad 79 when measured with a same object under a same condition.

Figure 14:
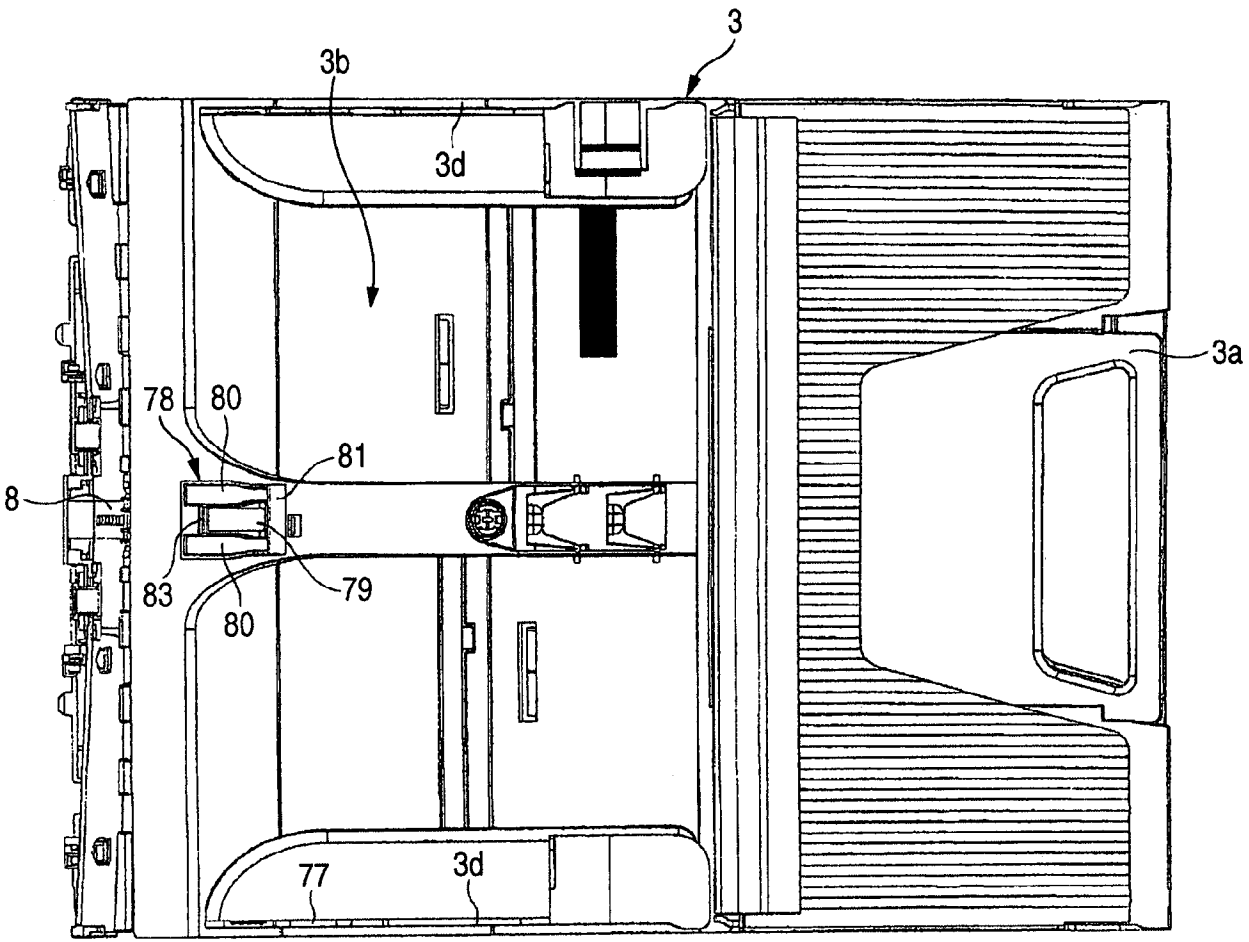
FIG. 14 is a plan view of the paper feed cassette.
Figure 15:
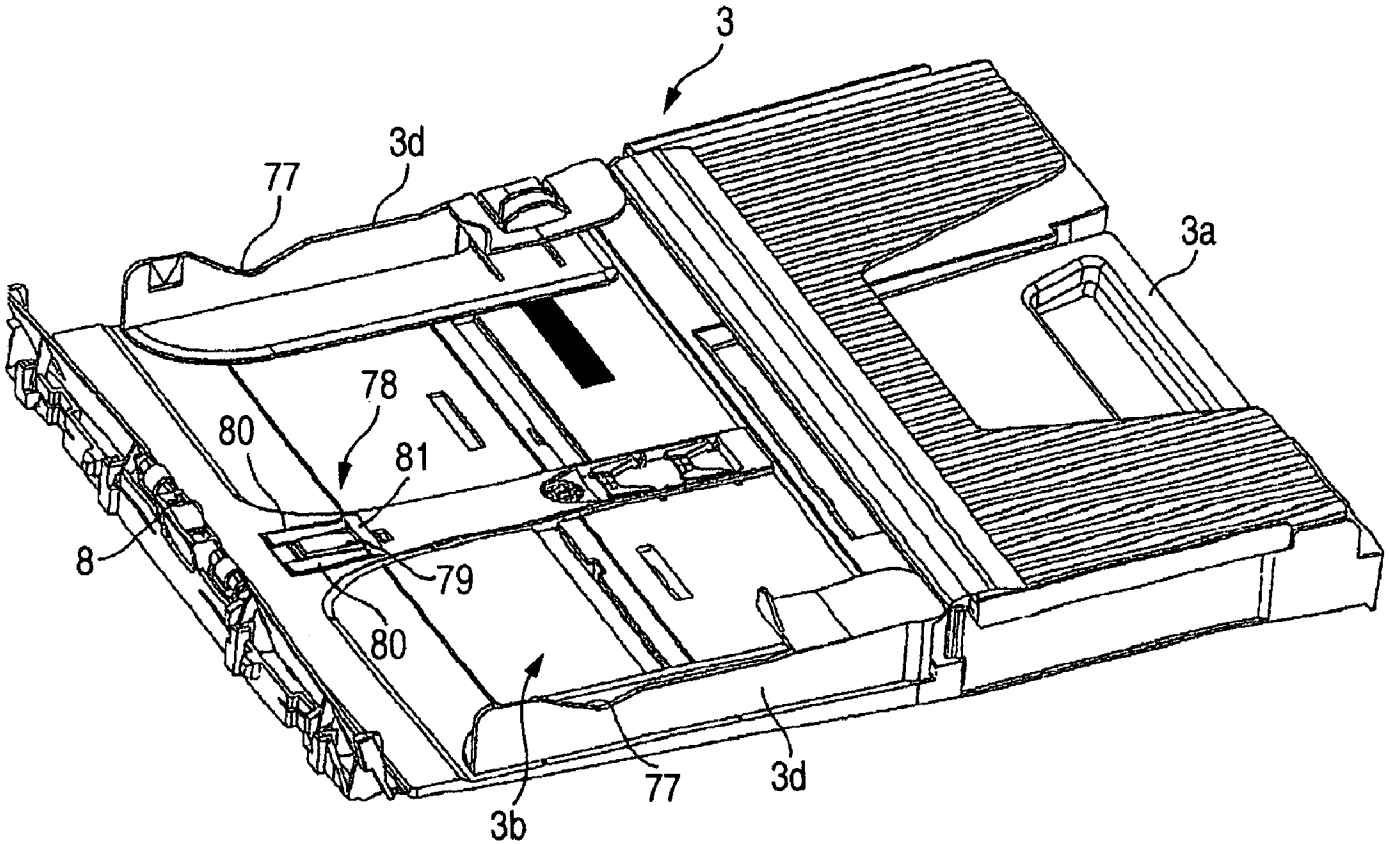
FIG. 15 is a perspective view of the paper feed cassette.
Figure 16:
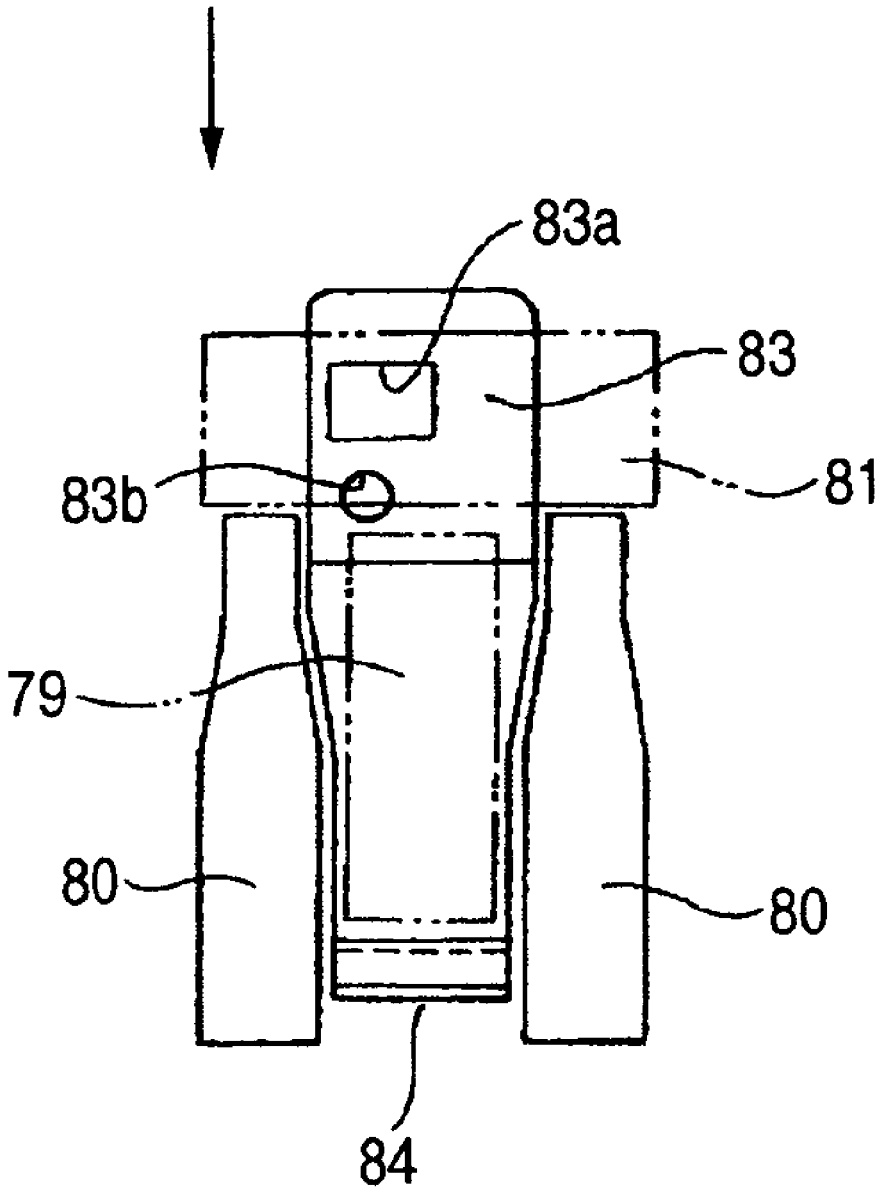
FIG. 16 is a plan view showing a positional relationship between a base pad and base plates.

In the embodiment, the base pad 79 and the base plate 80 are arranged in parallel with each other with respect to a direction orthogonal to the direction in which the paper P is transported (indicated by arrow in FIG. 16). Preferably, the base plates 80 are disposed in close proximity to the downstream edge of a jump platform 81 in the paper transport direction, with one base pad 79 interposed there between, wherein the jump platform 81 is integrally formed with the bottom plate 3*b* in a lifted manner and located downstream in the paper feed direction (see FIGS. 14 to 16). The two base plates 80 are fixed to the upper surface of the bottom plate 3*b* by means of an adhesive or the like. A through hole 82 is formed in the vertical direction in the area of the bottom plate 3*b* located between the pair of base plates 80. A base spring 83, an upper surface of which fixedly supports the base pad 79 by means of an adhesive, is located within the through hole 82. In the embodiment, the base spring 83 serves as a support member that supports the first friction member to be protrudable towards the feed roller with respect to the second friction member.

The cylindrical outermost peripheral member 6*b*1 of the paper feed roller 6*b* is formed from a material, such as synthetic rubber. The material and surface geometry (i.e., a friction coefficient) of the outermost peripheral member 6*b*1 are determined such that, when the paper feed roller 6*b* is rotationally pressed against the paper P, frictional force developing between the paper feed roller 6*b* and the paper P contacted by the same exceeds frictional force developing between the paper P contacted by the paper feed roller 6*b* and the paper P located immediately below the paper feed roller 6*b*. In the embodiment, an elastomer or EPDM (ethylene-propylene rubber) is adopted as the material, and a knurled grip is formed in the surface of the outermost peripheral member 61*b* in a direction perpendicular to the paper transport direction.

Similarly, the material and surface geometry (i.e., a friction coefficient) of the base pad 79 are determined such that, when the paper feed roller 6*b* is rotationally pressed against the paper P, frictional force developing between the paper pad 79 and the paper P contacted by the same exceeds frictional force developing between the paper P contacted by the paper pad 79 and the paper P located immediately above the base pad 79.

The material and surface geometry (i.e., a friction coefficient) of the base plate 80 are determined such that, when the paper feed roller 6*b* is brought into rotational pressed contact with the final piece of paper P, frictional force developing between the paper feed roller 6*b* and the paper P contacted by the same exceeds frictional force developing between the base pad 79 and the base plate 80 and the paper P contacted by them. Although in the embodiment stainless steel having low surface roughness is adopted as the base plate 80, nickel-plated steel plate may also be adopted.

Figure 19:
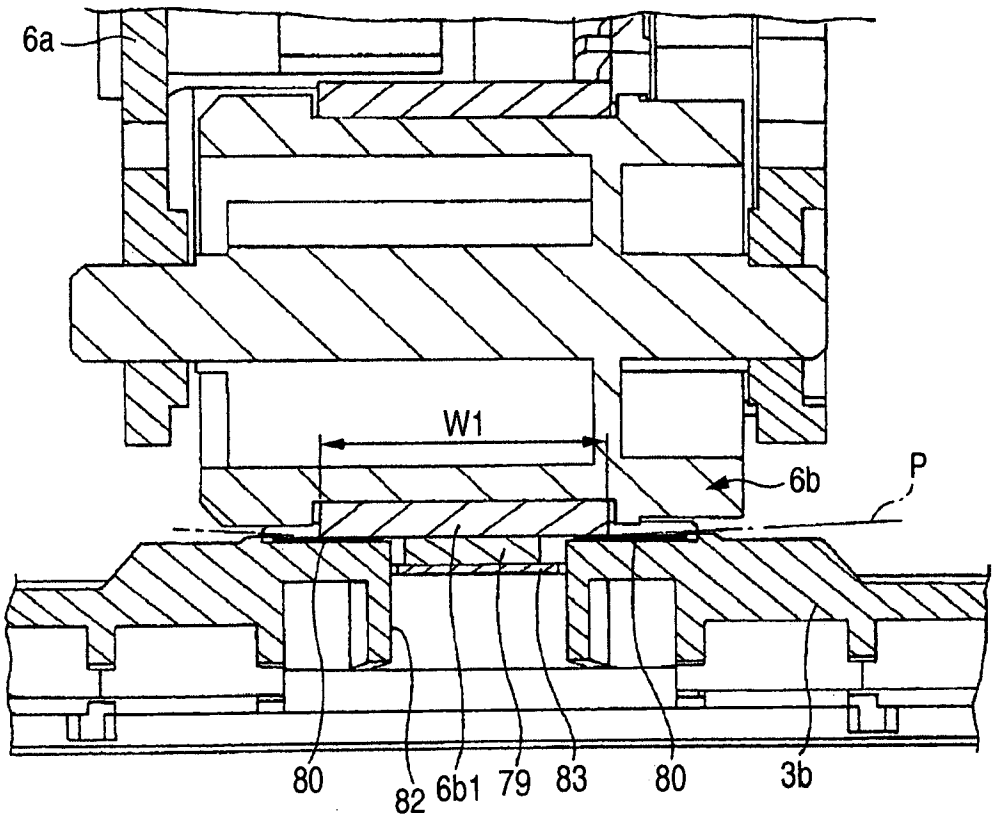
FIG. 19 is a cross-sectional view taken along line XIX-XIX in FIG. 18.

The width W1 of the outermost peripheral member 6*b*1 (the dimension of the outermost peripheral member in a direction orthogonal to the paper feed direction) is set such that the outermost peripheral member straddles at least an intermediate portion of the base plates 80 in the widthwise direction thereof with the base pad 79 interposed there between (see FIG. 19).

Figure 18:
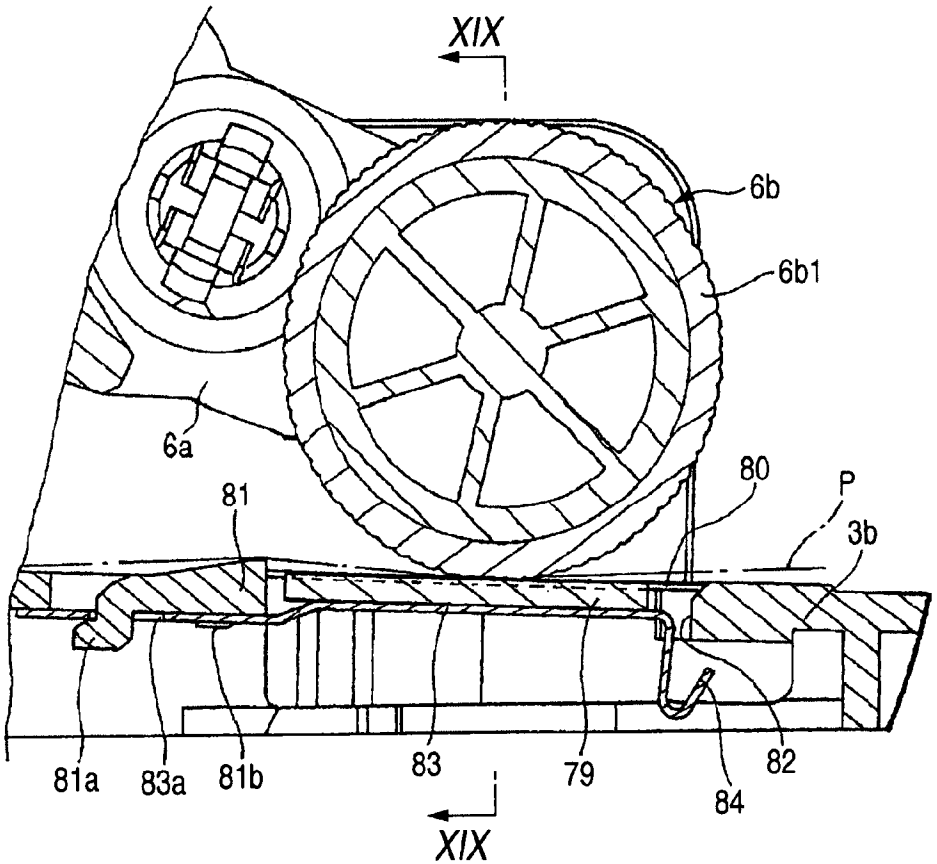
FIG. 18 is a partially enlarged side cross-sectional view for explaining a state where a last single sheet of paper is fed.

The base spring 83 formed from a metal plate spring having elasticity or the like is attached in an unremovable manner as a result of a latching hole 83*a* formed in the base portion of the base sprint 83 being latched by a latching claw 81*a* formed integrally on the lower surface of the jump platform 81 (see FIGS. 16 to 18). A positioning hole 83*b*, which is formed in the vicinity of the latching hole 83*a* of the base portion of the base spring 83, tightly fits around a projection 81*b*projecting from the lower surface of the jump platform 81, thereby preventing horizontal offset of the projecting direction of the base spring 83. Thus, the base spring 83 is supported on the base plate 3*b* in a cantilever fashion, and the tip end (free end) of the base sprint 83 is resiliently forced upward of the through hole 82.

A regulation piece 84 for preventing lift-up of the tip end (the free end or downstream end in the paper feed direction) of the base sprint 83 is provided at a position close to the tip end while being bent so as to assume a U-shaped cross-sectional profile. By means of this regulation piece, when base pad 79 is not pressed downward by the outermost peripheral member 6*b*1 of the paper feed roller 6*b* (including a state where the base pad 79 is not pressed by way of the paper P on the bottom plate 3*b*; these states are called non-loaded states), the tip edge (the upper edge) of the regulation piece 84 comes into contact with a part of the lower surface of the bottom plate 3*b* close to the through hole 82. As a result, of the surface (upper surface) of the base pad 79 on the base spring 83, an area of the surface of the base pad which contacts the paper feed roller 6*b* is regulated so as not to lift, by a given value (of 0.5 mm or thereabouts in the embodiment) or more, beyond the surfaces (upper surfaces) of the base plates 80 whose height in the corresponding position is fixed. The given value changes in accordance with the thickness, material, and two-dimensional geometry of the base spring 83. The only requirement is that the given value be designed such that the base pad 79 does not lift to the same height as that of the base plates 80 as a result of surrendering to the contacting force of the paper feed roller 6*b* when the paper P second from the last is fed. The height of the surface of the upstream part of the base pad 79 in the paper feed direction is set so as to become substantially the same as that of the surfaces (upper surfaces) of the base plates 80 located in the corresponding position, as well as being set such that, when the base pad 79 lifts to the same height as that of the base plates 80 as a result of being pressed by the paper feed roller 6*b*, the base pad 79 and the base plates 80 become substantially parallel to each other.

In the embodiment, the base spring 83 is formed into an essentially trapezoidal shape when viewed from the top, wherein the width of the base is greater than the width of the free end. The base plates 80 are formed into an essentially trapezoidal shape when viewed from the top, such that the upstream width becomes smaller than the downstream width, in contrast to the case of the base spring 83 (see FIG. 16).

According to the above configuration, the width required to arrange the base plates 80 while the base spring 83 is sandwiched there between can be made as short as possible. The cross-sectional flexural area of the base spring 83 can be made larger, thereby preventing concentration of stress.

When the base plates 80 serving as the members of low friction coefficient are formed from a plate of metal such as stainless steel or the like, high abrasion resistance and a low surface friction coefficient are achieved. Therefore, when compared with a case where the bottom plate 3*b* made of synthetic resin is utilized as the member of low friction coefficient, the action for feeding the final sheet of paper can be ensured without fail, as will be described later.

Next, the configuration of automatic ascending/descending of the paper feed arm 6*a* upon insertion and withdrawal of the paper feed cassette 3 in the bottom section of the housing 2 will be described. A cam follower member 75 of substantially tabular shape is parallel to the drive shaft 74 and integrally protrudes out of the synthetic resin paper feed arm 6*a*. The cam follower member 75 is disposed on a lower face side of the bottom plate 21*b* of the main frame 21, and extends to above a cam section 77, which will be described later, of the paper feed cassette 3. A bearing section 76 which integrally protrudes with the cam follower member 75 is inserted from an insertion hole 21*n* (see FIGS. 8, 10, and 11) bored in the bottom plate 21*b* to the upper face of the bottom plate 21*b*, and is fitted in the drive shaft 74 so as to be relatively rotational. Therefore, there is employed such a setting that, in a state where most portions of the paper arm 6*a* and the paper roller 6*b* which are pivoted to thus be ascended are housed in the upper face side through the opening 70 in the bottom plate 21*b*, the cam follower member 75 is parallel to the lower face of the bottom plate 21*b* substantially in the vicinity thereof.

Cam sections 77 are integrally formed on upper end faces of the lateral-opposite side plate sections 3*d*, which are opposite end sections in the direction of the Y axis of the storage section for paper P of the synthetic resin paper feed cassette 3 with the bottom plate 3*b* there between. The cam sections 77 slidingly contact the cam follower 75 in accordance with an insertion/withdrawal motion (motion in the direction of the X axis) of the paper cassette 3, thereby integrally ascending/descending the paper feed arm 6*a*, and, in association therewith, the paper feed roller 6*b*.

Figure 21:
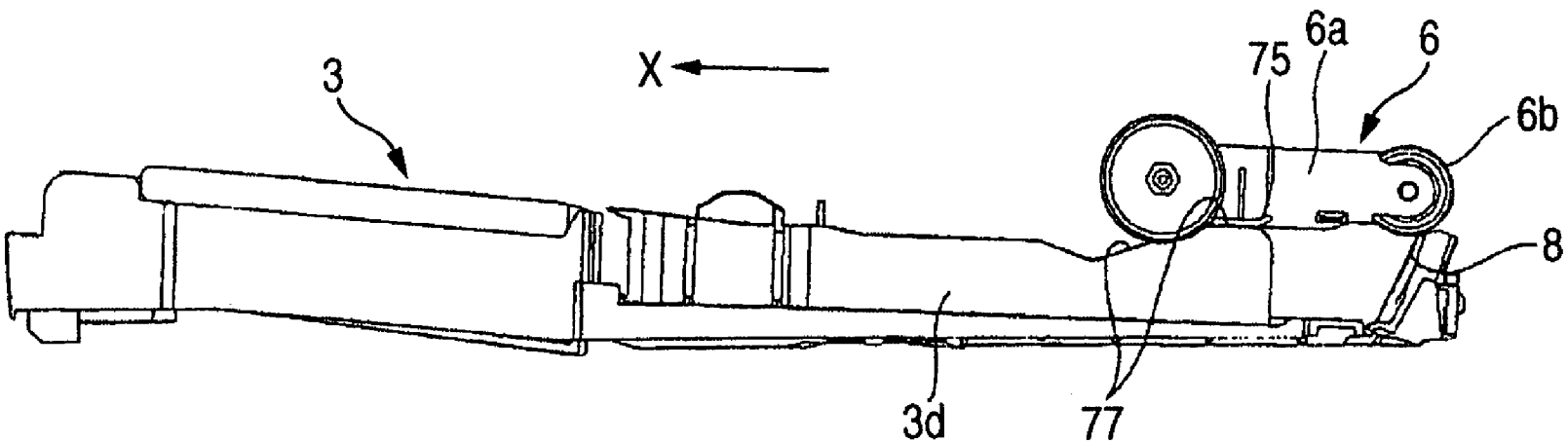
FIG. 21 is a side view showing a state where a paper feed roller has surmounted a sloped section of the paper feed cassette.
Figure 22A:
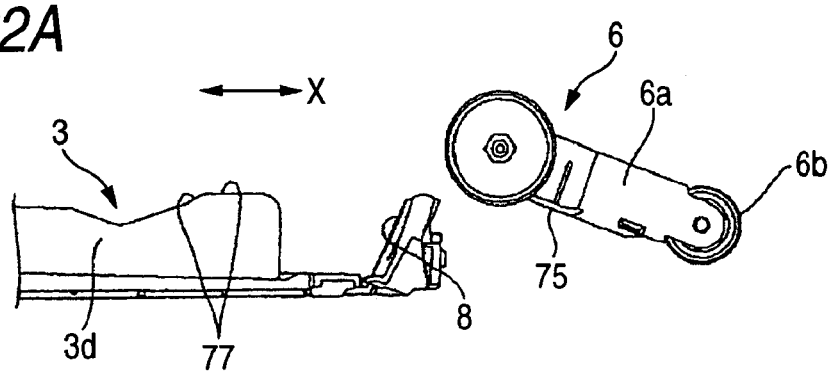
FIG. 22A is an explanatory view showing a state where the paper feed roller is separated from the paper feed cassette.

According to the above configuration, as shown in FIG. 22A, when the paper feed cassette 3 is inserted through the opening 2*a* on the front face of the housing 2, and a lower face of the cam follower member 75 is brought into contact with a leading end side (a side close to the sloped section 8) of the cam section 77, the cam follower member 75 is pushed up in accordance with an insertion/withdrawal motion of the paper feed cassette 3 (see FIG. 21). Integrally therewith, the paper feed arm 6*a* and the paper feed roller 6*b* are upwardly pivoted, whereby the paper feed arm 6*a* and the paper feed roller 6*b* pass above the sloped section 8. In a state where the paper feed arm 6*a* and the paper feed roller 6*b* are ascended, these members are housed in a space (within the main frame 21) above the bottom plate 21*b* through the opening 70. In addition, at this time, the cam follower member 75, of flattened shape, is also brought into contact with or vicinity of the lower face of the bottom plate 21*b*. Accordingly, vertical pivoting motion of the paper feed arm 6*a* and the paper feed roller 6*b* can be ensured without increasing vertical height of a space between the bottom plate 21*b* of the main frame 21, and the paper feed cassette 3. In other words, since a height of the main frame 21 from the paper feed cassette 3 to the bottom plate 21*b* can be set small, a compact image recording device 1 which is miniaturized in terms of overall height can be provided.

Figure 22B:
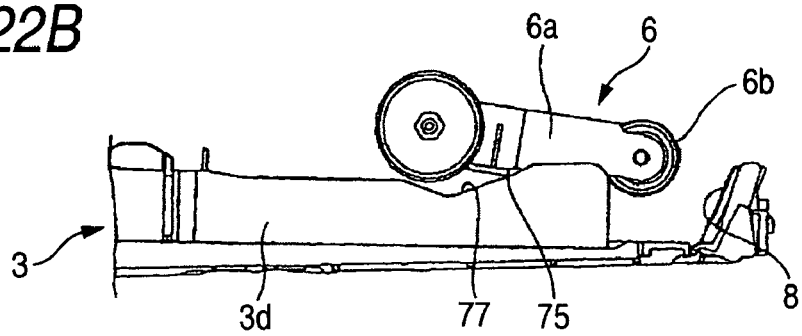
FIG. 22B is an explanatory view showing a state after the paper feed roller has surmounted the sloped section of the paper feed cassette.

When the cam follower member 75 passes beyond a topmost position of the cam section 77 and is located at a descending section, the paper feed arm 6*a* and the paper feed roller 6*b*, on which downward force is applied in accordance therewith, are also downwardly pivoted (see FIG. 22B). Here, the paper feed roller 6*b* can contact a topmost layer of the paper P stacked (accumulated) in the storage section 3*b*.

Figure 13:
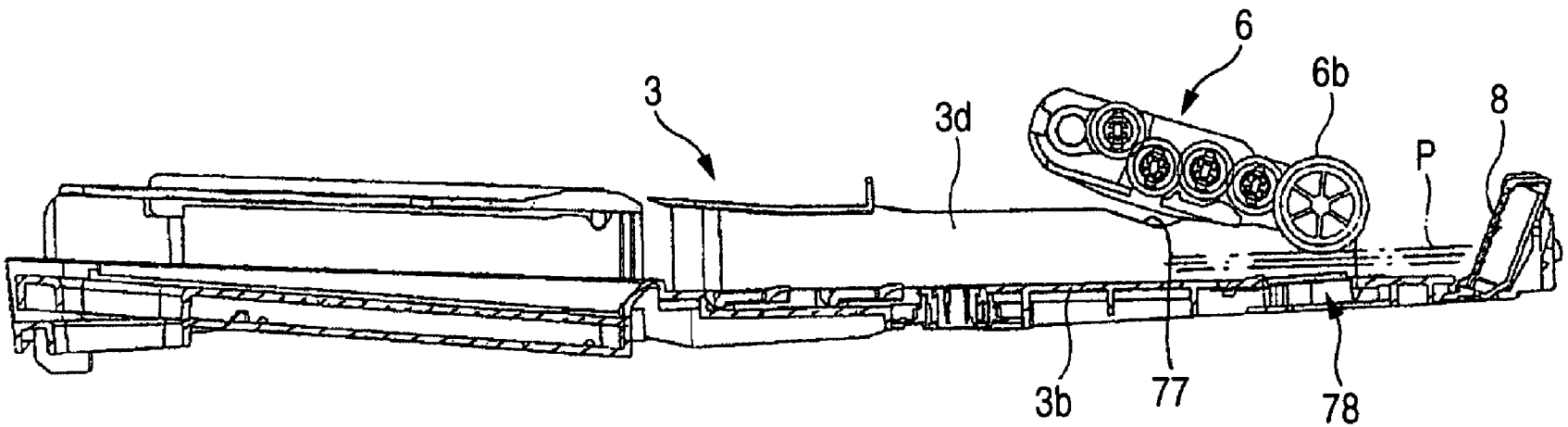
FIG. 13 is a cross-sectional view taken along line XIII-XIII in FIG. 12.
Figure 22C:
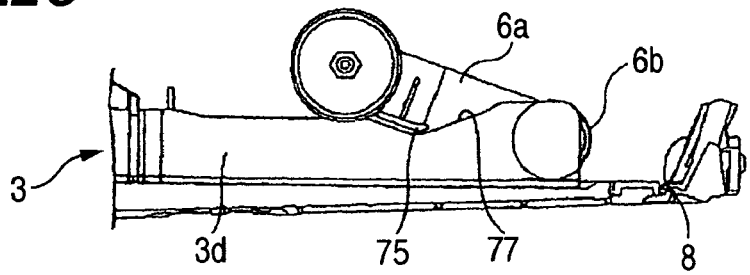
FIG. 22C is an explanatory view showing a state where the paper feed roller is at a lowermost position.

In a state where the paper feed cassette 3 is advanced in the housing 2 to the rearmost position (set state), when one end (lower end) of the cam follower member 75 of the paper feed arm 6*a* is brought into contact with a lowest-height position of the cam section 77, the paper feed roller 6*b* can contact the multiple sheet feed prevention member 78 at the bottom of the paper feed cassette 3 (see FIGS. 13 and 22C).

Thus, there is disposed the cam follower member 75 located lower than the bottom plate 21*b* of the main frame 21 in the paper feed mechanism 6; and, in the paper feed cassette 3, there is disposed the cam section 77 for, at least temporarily, causing the paper feed mechanism 6 to upwardly/downwardly pivot together with the cam follower member 75 in accordance with an insertion/withdrawal motion of the paper feed cassette 3 in relation to the housing 2 (main body case). Therefore, the paper feed mechanism 6 can be ascended/descended in accordance with the insertion/withdrawal motion of the paper feed cassette 3, thereby facilitating operations.

Figure 10:
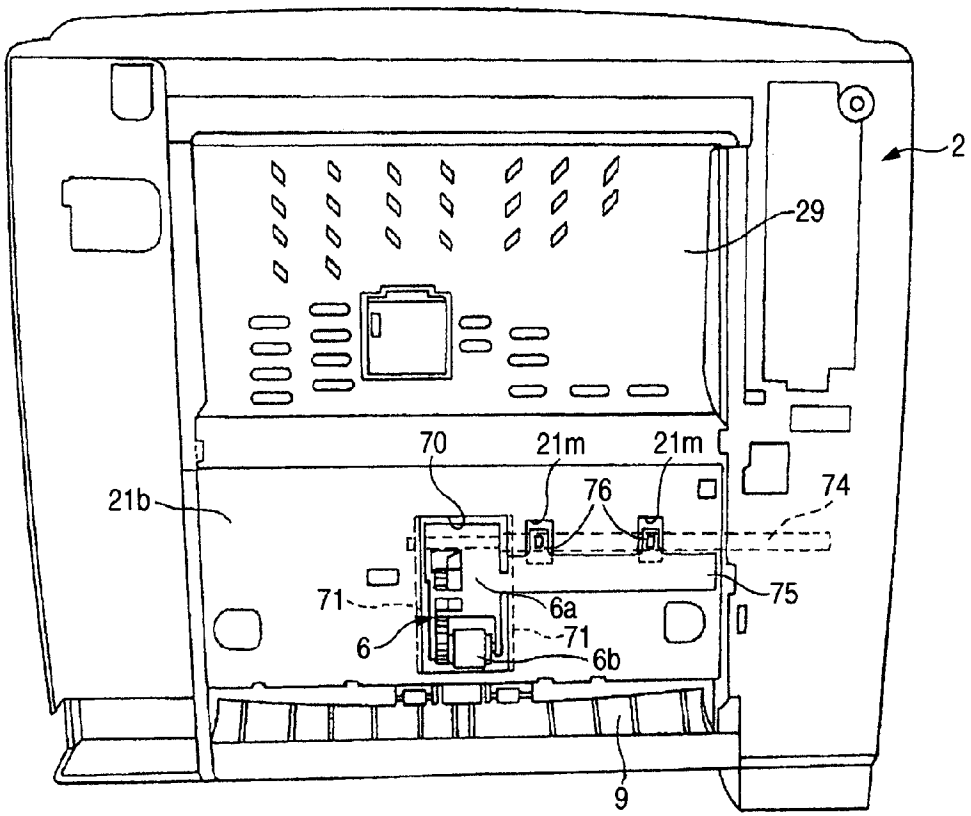
FIG. 10 is a bottom view of a housing.

In the hitherto-illustrated embodiment, the opening 70 for housing the paper feed arm 6*a* and the paper feed roller 6*b* when the same ascend higher than the bottom plate 21 is formed (see FIGS. 8 and 10). Alternatively, a storage section upwardly recessed and opening downward may be bulgingly formed in the bottom plate 21*b* by means of pressing, or the like. Similarly, in order to cause the most-ascending position of the cam follower member 75 to be higher than the bottom plate 21*b*, a downwardly-opening recessed section in which the cam follower member 75 can fit may be formed.

In the above configuration, an appropriate number of sheets of paper P are stacked in the paper feed cassette 3, and the paper cassette 3 is inserted through the front-face opening 2*a* of the housing 2. In a state where the paper feed roller 6*b* is descended, whereby an outermost peripheral member 6*b*1 of the paper feed roller 6*b* presses down the base pad 79 by way of the paper P, when a paper feed command is provided, the drive shaft 74 rotates in a predetermined direction (in the embodiment, clockwise in FIG. 17), and the paper feed roller 6*b* rotates counterclockwise by way of engagement between the gears 6*c*1 to 6*c*7. A leading end of uppermost paper P of the stacked paper P collides with the sloped section 8. Accordingly, the paper P is fed one sheet at a time to the U-turn path 9 while being separated. At this time, if the paper P is fully-stacked, even when an upward spring force of the base spring 83 is countered by to the weight of the paper P, the lowermost paper P is prevented from moving by the own weight of the paper P. Next, when the paper P is reduced in number to a certain degree, the upward spring force of the base spring 83 itself prevails. Since the base pad 79 is supported so that a surface (upper face) thereof is located higher than the surfaces (upper faces) of the base plates 80, the lowermost paper P in contact with the surface of the base pad 79 having a high friction coefficient is not dragged in the feed direction when another sheet of the stacked paper P is moved. Thus, a so-called multi-feed phenomenon can be prevented.

As shown in FIG. 18, when a last one sheet of paper P on the bottom plate 3*b* is fed, the lower face of the paper P sticks to the surface of the base pad 79 of high friction coefficient, and the paper P cannot be stripped from the surface of the base pad 79 with ordinary rotational drive force of the paper feed roller 6*b*. In this state, the paper feed roller 6*b* fails to rotate, and the paper feed arm 6*a* is pivoted clockwise in FIG. 18 (in the direction in which the paper feed roller 6*b* pushes the base pad 79 downward), thereby increasing contacting force. The free end of the base spring 83 surrenders to the contacting force and, eventually, is displaced downward. When the surface of the base pad 79 becomes flush with the surface of the base plates 80 (i.e., comes to a level where the paper pad remains unlifted), the outermost periphery surface (the outermost peripheral member 6*b*1) of the paper feed roller 6*b* is pressed, by way of the paper P, against the surfaces of the base plates 80 fixed in terms of vertical position. Hence, most of the downward force exerted by the paper feed arm 6*a* is received by the base plates 80, thereby decreasing the nipping force exerted on the paper P between the base pad 79 and the paper roller 6*b*. Therefore, frictional resistance between the surface of the base pad 79 and the lower face of the paper P is decreased. As a result, the lowermost paper P, which slides easily in relation to the base plates 80 of lower friction coefficient, can be fed by the frictional force of the outermost periphery surface (the outermost peripheral member 6*b*1) of the rotating paper feed roller 6*b*.

In a case where: a single face (recording face) of the paper P has been subjected to special surface processing, for example, the recording face of the paper P is coated with silica (silicon dioxide: $SiO_2$) or alumina (dialuminum trioxide: $Al_2O_3$)—as in the case of inkjet-dedicated paper—the paper P is stacked in such a manner that the face having been subjected to the special surface processing opposes the surface of the base pad 79 and is easily brought into close contact therewith; and when, for instance, the paper P is stacked with the recording face facing downward, and recording by means of inkjet printing is performed on the recording face in a state that the recording face is caused to face upward by means of a U-turn path, the separation effect on the paper P by virtue of the above-mentioned mechanism is further exerted, whereby even a last sheet can be fed without fail.

Meanwhile, in the embodiment, the horizontal paper feed cassette 3 has been employed as a tray. Alternatively, a paper feed tray disposed in an inclined state may be employed. As another embodiment of the member of high friction coefficient, another material different from cork, such as felt, may be employed, so long as the material has a high friction coefficient in relation to the paper P.

In addition, when the base spring 83 serving as the support member is formed from an elastic member, relative displacement of vertical position of the surface of the base pad 79 in relation to the surfaces of the base plates 80 which are substantially fixed in terms of vertical position can be automatically regulated in accordance with a pressing force by the paper feed roller 6*b* and a weight of the stacked paper P. Accordingly, the configuration is simplified. In addition, in a case where the base spring 83 is supported in a cantilever manner, when such an arrangement that an amount of displacement is increased on a feed downstream side is employed, a leading end edge in the paper feeding direction of the paper P interferes less easily with an end section on a feed downstream side of the base pad 79. Accordingly, an advantage of eliminating a possibility of damaging the leading end edge in the paper feeding direction of the paper P is exerted.

Furthermore, when the base plates 80 of low friction coefficient and the base pad 79 of high friction coefficient are arranged in parallel with respect to the direction perpendicular to the paper feeding direction, areas of the base plate and the base pad contacting with the paper feed roller (i.e., the portions of the paper nipped between the base plates, the base pad and the paper feed roller 6*b*) become linear in relation to the direction perpendicular to the paper feeding direction. Accordingly, the direction in which the paper is fed by the paper feed roller 6*b* can be rendered constant when the friction coefficient exhibits excessive variations (at a time of occurrence of switching between the state where the paper P abuts surfaces of the base plates 80 and the state where the same abuts the surface of the base pad 79). In particular, when the base plates 80 are disposed on both sides of the base pad 79, slanting (skewing) in the paper feeding direction of the paper P by means of the paper feed roller 6*b* does not occur, whereby the advantage of eliminating a cause for a paper jam is yielded.

Alternatively, in place of a supporting member of a plate spring type, serving as a supporting member for supporting the member of high friction coefficient (the base pad 79) so that the position of the surface of the same can be changed between a position higher than the surface of the member of low friction coefficient (the base plate 80) and a position not higher than the same, there may be employed such a configuration that a coil spring supports the base pad 79 in an elastic manner.

In the embodiment, the base plates 80, which are members of high friction coefficient, are disposed on opposite ends of the base pad 79, which is a member of low friction coefficient. In contrast, the base pads 79 may be disposed on opposite ends of the base plate 80. Even when the base plate 80 is fixed to the tray, and the base pads 79 are fixed to the base spring 83, the same advantages as those in the embodiment can be obtained.

In addition, even in a case where the base plate 80 is disposed only on a single side—in contrast to the case of the embodiment where the base plates 80 are disposed on the opposite sides of the base pad 79—an advantage of preventing multi-feed can be obtained. When the guide of the paper P performs not center-alignment but side-alignment, a component force for causing skewing of the paper P is generated. By utilizing the force, only a last sheet of paper P can be fed in such a manner as to fit along the guide.

When the tray is the paper feed cassette 3 which stores the paper P stacked substantially horizontally and which is disposed in the main body case (the housing 2) of the image recording device so as to allow insertion and withdrawal therein and there from, and paper feed mechanism for feeding the paper P stacked in the paper feed cassette 3 is attached to the main body case in a vertically rotatable manner, the present invention can be easily applied to a printer or a facsimile machine. In addition, insertion and withdrawal in and from the paper feed cassette 3 is facilitated.

As described in detail above, according to the embodiment, in a state where a plurality of sheets of recording medium are stacked on the tray, the surface of the member of high friction coefficient (a first friction member) is configured to be higher than the surface of the member of low friction coefficient (a second friction member). Thus, a recording medium at a lowermost position among the stacked recording medium is in contact with the surface of the first friction member. Accordingly, when another recording medium at a higher layer (higher position) than the lowermost recording medium is fed by the feed roller, the lowermost recording medium is not dragged, thereby preventing occurrence of a multi-feed of the recording medium.

When a last sheet of the recording medium on the tray is fed, since the surface of the first friction member is supported at a position not higher than the surface of the member of low friction coefficient, frictional force generated on a face of the recording medium against the tray is governed by the second friction member. Accordingly, an advantage that the recording medium can be fed without sticking of the recording medium to the first friction member is exerted.

In particular, when a single face (recording face) of the recording medium has been subjected to special surface processing, and the recording medium is stacked in such a manner that the face having been subjected to the special surface processing opposes the surface of the first friction member and is easily brought into close contact therewith, the last sheet of the recording medium can be fed by means of the feed roller without fail.

According to the embodiment, a contacting portion between the second friction member and the first friction member (i.e., a nip portion of the recording medium with the feed roller) becomes linear in relation to a direction perpendicular to the paper feeding direction. According to this configuration, a direction of feeding by means of the paper feed roller can be rendered constant even when a friction coefficient exhibits excessive variation (at a time of switching between a state where the recording medium abuts a surface of the first friction member and a state where the same abuts a surface of the second friction member). In addition, according to the embodiment, the second friction member is disposed at each opposite lateral sides of the first friction member. Accordingly, the paper feeding direction of the recording medium realized by means of the feed roller does not skew, whereby an advantage of eliminating a cause for a paper jam is exerted.

According to the embodiment, the first friction member is supported by the support member, and its location can be selectively changed between a position higher than the surface of the second friction member (a lifted position; or a protruded position) and a position not higher than the same (a unlifted position; or a retracted position). Accordingly, since the support member moves so as to locate the first friction member at the unlifted position only when the last sheet of the recording member is fed, the configuration is simplified.

According to the embodiment, the support member is constituted of an elastic member. Accordingly, a relative position of the surface of the first friction member in relation to the second friction member is varied in accordance with a pressing force exerted by the feed roller and with a weight of the stacked recording mediums. By virtue of this configuration, the recording medium can be automatically switched between a state governed by a frictional force of the first friction member and a state governed by a frictional force of the second friction member.

According to the embodiment, the support member is formed as a cantilever, and is configured so that the support member displaces in relation to a surface where the recording medium is placed on the tray by a greater distance at a downstream side of a feeding direction of the recording-medium than at an upstream side. Accordingly, the recording member does not oppose an end face of the support member, thereby preventing damage to an edge of the recording medium on the downstream side in the paper feeding direction.

According to the embodiment, the base portion of the support member is fixed to the tray, and a latching section for preventing lift-up is disposed at a free end side of the support member. According to this configuration, lift-up of the free-end side of the cantilever support member from a face where the recording medium is placed on the tray can be prevented without fail. Accordingly, there is exerted an advantage that, even when a user touches the support member unintentionally, the function of lift-up prevention will not be lost.

According to the embodiment, a width required for arranging the first friction member and the second friction member in parallel can be reduced, thereby enabling miniaturization of the tray.

According to the embodiment, when the second friction member is constituted of a plate material of metal such as stainless steel, the second friction member has great abrasion resistance and a low friction coefficient. Accordingly, an advantage that the last sheet can be fed more reliably, as compared with a case where a synthetic resin surface is utilized as the second friction member, is exerted.

According to the embodiment, when: a single face (recording face) of the recording medium has been subjected to special processing, and the recording medium is stacked in such a state that the face having be subjected to the special surface processing opposes the surface of the first friction member and is easily brought into close contact therewith, the invention can be applied to, for instance, such an image recording device that the recording mediums are horizontally stacked with the recording faces facing downward, and recording is performed in a state that the recording face is caused to face upward by means of a U-turn path. In this case, the separation advantage on the recording medium is further exerted, thereby enabling feeding of even a last sheet without fail. In addition, when the U-turn path is decreased in diameter, and when the recording medium is increased in flexural rigidity, the advantage of the invention is enhanced.

The foregoing description of the embodiment has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A recording medium feeder comprising:

a tray configured to receive a plurality of recording mediums, the plurality of recording mediums being stacked on the tray;

a feed roller, having a rotational axis that moves substantially vertically with respect to the tray between two locations based on an amount of recording mediums stacked on the tray and feeds the recording mediums stacked on the tray;

a first friction member provided on the tray at a position opposing the feed roller and having high friction coefficient, said first friction member having a first surface; and a second friction member provided on the tray at a position opposing the feed roller and having low friction coefficient that is lower than the friction coefficient of the first friction member, said second friction member having a second surface, wherein the first friction member is configured to move between a protruded position in which the first surface protrudes above the second surface toward the feed roller and a retracted position in which the first surface is arranged to be not higher than the second surface.

2. The recording medium feeder according to claim 1, wherein the first friction member and the second friction member are arranged in parallel in relation to a recording medium feeding direction, and wherein the feed roller is configured to be contactable with both of the first friction member and the second friction member.

3. The recording medium feeder according to claim 2, wherein the second friction member is disposed on each of opposite sides of the first friction member.

4. The recording medium feeder according to claim 1, further comprising a support member that supports the first friction member to be protrudable towards the feed roller with respect to the second friction member.

5. The recording medium feeder according to claim 4, wherein the second friction member is fixed to the tray, and wherein the support member is constituted of an elastic member.

6. The recording medium feeder according to claim 4, wherein the support member is formed as a cantilever having one end fixed to the tray and the other end configured as a free end, and wherein the support member is configured so that the support member displaces in relation to a surface of the tray by a greater distance at a downstream side of a recording medium feeding direction than at an upstream side.

7. The recording medium feeder according to claim 6, wherein the support member includes a base portion that is fixed to the tray and a latching section that abuts with the tray from a backside of the tray.

8. The recording medium feeder according to claim 4, wherein the support member is formed as a cantilever having one end fixed to the tray at an upstream side of a recording medium feeding direction, and the other end configured as a free end provided at a downstream side of the feeding direction, wherein the support member is formed in a shape that a width on the one end side is greater than a width on the free end side, and wherein the second friction member is formed so that a width on the upstream side of the recording medium feeding direction is smaller than a width on the downstream side.

9. The recording medium feeder according to claim 1, wherein the second friction member is formed of a plate metal member.

10. The recording medium feeder according to claim 9, wherein the second friction member is made of stainless steel.

11. The recording medium feeder according to claim 1, wherein the first friction member is made of cork.

12. The recording medium feeder according to claim 1, wherein the recording medium feeder handles the recording mediums stacked on the tray with recording faces thereof facing downward.

13. The recording medium feeder according to claim 12, wherein the recording medium feeder conveys the recording mediums having the recording faces that are coated with at least one of silica and alumina.

14. The recording medium feeder according to claim 1, wherein the first friction member is configured to be in the retracted position when a last one of the recording medium is fed by the feed roller.

15. The recording medium feeder according to claim 1, further comprising a feed arm that supports the feed roller at one end thereof and being pivotally supported at the other end thereof by a drive shaft that transmits a rotation torque to the feed roller.

16. An image recording device comprising:

a main body case;

a tray configured to receive a plurality of recording mediums, the plurality of recording mediums being stacked horizontally, the tray being allowed to be inserted into and withdrawn from the main body case;

a feed roller, having a rotational axis that moves substantially vertically with respect to the tray between two locations based on an amount of recording mediums stacked on the tray and feeds the recording mediums stacked on the tray;

a first friction member, having a first surface, provided on the tray at a position opposing the feed roller and having high friction coefficient;

a second friction member, having a second surface, provided on the tray at a position opposing the feed roller and having low friction coefficient that is lower than the friction coefficient of the first friction member; and an image forming section that forms an image on the recording mediums fed by the feed roller, wherein the first friction member is configured to move between a protruded position in which the first surface protrudes above the second surface toward the feed roller and a retracted position in which the first surface is arranged to be not higher than the second surface.

17. The image recording device according to claim 16, wherein the first friction member and the second friction member are arranged in parallel in relation to a reading medium feeding direction, and wherein the feed roller is configured to be contactable with both of the first friction member and the second friction member.

18. The image recording device according to claim 16, further comprising a support member that supports the first friction member to be protrudable towards the feed roller with respect to the second friction member, wherein the support member is formed as a cantilever having one end fixed to the tray and the other end configured as a free end, and wherein the support member is configured so that the support member displaces in relation to a surface of the tray by a greater distance at a downstream side of a recording medium feeding direction than at an upstream side.

19. The image recording device according to claim 16, wherein the recording medium feeder handles the recording mediums stacked on the tray with recording faces thereof facing downward.

20. The image recording device according to claim 16, wherein the first friction member is configured to be in the retracted position when a last one of the recording medium is fed by the feed roller.

21. The image recording device according to claim 16, further comprising a feed arm that supports the feed roller at one end thereof and being pivotally supported at the other end thereof by a drive shaft that transmits a rotation torque to the feed roller.

22. The recording medium feeder according to claim 1, wherein, in a first of the two locations, the feed roller is apart from the first friction member and the second friction member and, in a second of the two locations, the feed roller presses the first friction member to move to the retracted position.

23. The image recording device according to claim 16, wherein, in a first of the two locations, the feed roller is apart from the first friction member and the second friction member and, in a second of the two locations, the feed roller presses the first friction member to move to the retracted position.

* * * * *